US012807401B2

(12) United States Patent
Hauck et al.

(10) Patent No.: US 12,807,401 B2
(45) Date of Patent: Nov. 24, 2026

(54) ROD CRATE

(71) Applicant: Rod Deployment Systems, LLC, Dickinson, ND (US)

(72) Inventors: Tobias Hauck, Dickinson, ND (US); Tanner Hopfauf, Dickinson, ND (US)

(73) Assignee: Rod Deployment Systems, LLC, Dickinson, ND (US)

( * ) Notice: Subject to any disclaimer, the term of this patent is extended or adjusted under 35 U.S.C. 154(b) by 19 days.

(21) Appl. No.: 18/929,896

(22) Filed: Oct. 29, 2024

(65) Prior Publication Data

US 2025/0136358 A1 May 1, 2025

Related U.S. Application Data

(60) Provisional application No. 63/646,007, filed on May 13, 2024, provisional application No. 63/595,004, filed on Nov. 1, 2023.

(51) Int. Cl.

| | |
|---|---|
| ***E21B 19/14*** | (2006.01) |
| ***B65D 88/02*** | (2006.01) |
| ***B65D 90/00*** | (2006.01) |
| ***B65D 90/22*** | (2006.01) |

(52) U.S. Cl.

CPC ..... *B65D 90/004* (2013.01); *B65D 88/02* (2013.01); *B65D 90/22* (2013.01); *B65D 2590/0058* (2013.01); *E21B 19/14* (2013.01)

(58) Field of Classification Search

CPC ..... B65D 90/004; B65D 88/02; B65D 90/22; B65D 2590/0058; E21B 19/14; E21B 19/15; E21B 19/155; E21B 19/18; E21B 19/20

USPC ..... 414/22.51–22.71; 211/70.4

See application file for complete search history.

(56) References Cited

U.S. PATENT DOCUMENTS

| | | | |
|---|---|---|---|
| 1,971,609 | A | 8/1934 | Harrah |
| 2,311,932 | A | 2/1943 | Deckard |
| 3,212,593 | A | 10/1965 | Reischl |
| 3,633,937 | A | 1/1972 | Hlinsky |
| 4,274,778 | A | 6/1981 | Putnam |
| 4,445,579 | A | 5/1984 | Bello |

(Continued)

FOREIGN PATENT DOCUMENTS

| | | | | |
|---|---|---|---|---|
| DE | 202010002573 U1 | * | 7/2010 | ..... B65G 1/0442 |
| GB | 2294448 A | * | 5/1969 | ..... B66C 1/16 |

(Continued)

*Primary Examiner* — Lynn E Schwenning

(74) *Attorney, Agent, or Firm* — Mai-Tram D. Lauer; Westman, Champlin & Koehler, P.A.

(57) ABSTRACT

A crate includes a frame and first and second rod guides configured to be spaced along the frame. The first rod guide includes a first plurality of fingers, and the second rod guide comprises a second plurality of fingers. The first and second plurality of fingers are configured to be aligned with each other to define a first rod receiving slot between two adjacent fingers of the first plurality of fingers and a second rod receiving slot between two adjacent fingers of the second plurality of fingers. The first and second rod receiving slots are configured to accept a rod from a first side of the frame. A cribbing bar has a plurality of saddles, wherein a first saddle is aligned with the first and second rod receiving slots. A shaft extends through an aperture of the cribbing bar. A method of arranging a plurality of elongated rods is described.

20 Claims, 17 Drawing Sheets

(56) References Cited

U.S. PATENT DOCUMENTS

| | | | | |
|---|---|---|---|---|
| 4,899,832 | A | 2/1990 | Bierscheid, Jr. | |
| 5,020,947 | A | 6/1991 | Marcelius | |
| 5,174,389 | A | 12/1992 | Hansen | |
| 5,375,667 | A | 12/1994 | Trevisani | |
| 6,113,334 | A | 9/2000 | Riva | |
| 6,202,863 | B1 * | 3/2001 | Grenier | B65D 88/123 414/22.62 |
| 6,261,037 | B1 * | 7/2001 | Richards | F16L 3/2235 410/36 |
| 6,966,106 | B1 * | 11/2005 | Roodenburg | E21B 19/14 29/407.1 |
| 7,922,011 | B2 | 4/2011 | Knight et al. | |
| 7,922,012 | B2 | 4/2011 | Sisley | |
| 8,083,009 | B2 * | 12/2011 | Comacchio | E21B 19/14 414/22.58 |
| 8,490,718 | B2 | 7/2013 | Lunde | |
| 8,719,118 | B2 * | 5/2014 | Hacker | E21B 19/14 700/229 |
| 8,882,054 | B1 * | 11/2014 | Maki | E21B 19/15 248/68.1 |
| 9,228,398 | B2 | 1/2016 | Behrens | |
| 9,523,249 | B2 | 12/2016 | Binder et al. | |
| 10,138,691 | B2 | 11/2018 | Kos et al. | |
| 10,258,153 | B2 | 4/2019 | Patton, Jr. | |
| 10,584,541 | B2 | 3/2020 | Reddy et al. | |
| 10,612,692 | B2 | 4/2020 | Cowie et al. | |
| 10,808,466 | B2 * | 10/2020 | Porter | E21B 19/20 |
| 10,927,615 | B2 | 2/2021 | De Mul et al. | |
| 11,661,803 | B2 * | 5/2023 | Hauck | E21B 19/143 414/22.54 |
| 2001/0031184 | A1 | 10/2001 | Gloystein | |
| 2005/0236157 | A1 | 10/2005 | Logan | |
| 2010/0239404 | A1 * | 9/2010 | Blanchard | E21B 19/155 414/800 |
| 2014/0027106 | A1 | 1/2014 | Huseman et al. | |
| 2014/0027395 | A1 | 1/2014 | Benoit et al. | |
| 2014/0332483 | A1 * | 11/2014 | Schad | E21B 19/15 211/70.4 |
| 2015/0166260 | A1 | 6/2015 | Pham et al. | |
| 2019/0322206 | A1 | 10/2019 | Lamy et al. | |

FOREIGN PATENT DOCUMENTS

| | | |
|---|---|---|
| GB | 2083106 A | 3/1982 |
| WO | 0043235 | 7/2000 |

* cited by examiner

ROD CRATE

CROSS REFERENCE TO RELATED APPLICATIONS

This application claims the benefit of priority from U.S. Provisional Patent Application No. 63/595,004, filed Nov. 1, 2023. Additionally, this application claims the benefit of priority from U.S. Provisional Patent Application No. 63/646,007, filed May 13, 2024. Both of these priority applications are entitled "Rod Crate," and the contents of both priority applications are hereby incorporated by reference.

BACKGROUND

Sucker rods are utilized in conjunction with above ground pumping units and attached downhole equipment for the extraction of crude oil from below the earth's surface. Rods are provided in various lengths, are typically made of either steel or fiberglass, and have typical diameters between ⅝-inch (1.6 cm) and 1⅛ inch (2.9 cm) and a length of about 24 feet (7.3 m). Each rod is equipped with a coupler, allowing two or more rods to be screwed together and extended into the wellbore to the downhole pump. The rods, once connected to each other, are known as a rod string. The rod string is attached to a pumping unit at the earth's surface and to a downhole pump in the wellbore deep below the earth's surface. As the pumping unit is powered, it lowers and raises the rod string and therefore the downhole pump. As the downhole pump is raised and lowered while submersed in liquid crude oil, it pulls the liquid to the earth's surface using a series of check valves that permit the fluid to move upward and prevent it from escaping from the bottom.

Depending on the depth of the liquid zone (producing zone) in which the downhole pump is set, a rod string can be made up of hundreds of individual rods. A workover rig and associated equipment are used above the ground surface in assembly of the rods and lowering them and other downhole equipment down the wellbore. During initial installation, the downhole equipment and individual rods are lowered from above the ground surface into the wellbore in sequence. Conventionally, two members of the workover rig crew carry an individual rod from a transport cribbing to the wellbore. The workover rig, operated by a crew member, lifts one end of the rod so that it hangs vertically. The pump is held at the top of the wellbore, where the bottom end of the rod is threaded to it. The pump and rod are lowered by the workover rig until the top of the rod is at the top of the wellbore. Assembly of the rod string begins, in which a second rod is threaded to the first. The second rod is lowered until the top of the rod is at the top of the wellbore. This process is repeated until the pump is at the desired depth.

Commonly, a tool called a rod tong is operated by a crew member and is used to screw one rod to another. A rod tong holds one rod stationary while rotating the other rod until they are screwed together. Throughout the life of the well, a rod string may have to be removed from the wellbore and re-installed several times due to downhole equipment, piping, or rod failures. Rod failures typically start as surface imperfections on the rod and proceed to larger fractures caused by mechanical stress, the corrosive nature of the downhole environment, and damage incurred while handling the rods, among other factors.

The conventional practices associated with the transport, removal and installation of rods typically result in rod damage, crew member fatigue, and downtime for the well.

The carrying of the rods by the crew members from the storage area or transport trailer to the wellbore is known as "tailing." "Tailing out" is when the rods are carried from the wellbore to the storage area or to the transport trailer. Tailing out requires the workover rig to lift a rod from the wellbore. When the rod is lifted, a crew member physically moves the bottom end of the rod out and away from the rig as the operator of the rig simultaneously lowers the top of the rod to the rig floor or ground surface, where the top end of the rod is removed from the rig's lifting equipment and supported by a second crew member. The two crew members now fully support the weight of the removed rod. The crew members carry the rod to a designated area, where it is set down and laid horizontally either on a stand or on the ground surface. There it lies until it is either removed from the location or reassembled into a rod string and lowered back into the wellbore.

The conventional method of tailing rods "out" requires one crew member to support approximately half the rod weight while walking a minimum distance equal to the length of the rod over the ground surface or possibly down steps off the rig floor, in addition to a desired distance away from the rig. It also requires a second crew member to support the weight of the other end of the rod when it is removed from the rig's lifting equipment; the second crew member follows the first crew member to the location where the rod will be laid down.

Tailing rods "in" uses the same processes but in the reverse order. Two crew members carry the rod from the storage area to the wellbore. Once at the wellbore, one crew member affixes the rod to the workover rig's lifting equipment. The rig operator lifts the rod vertically into the air until the bottom of the rod is at the top of the wellbore. The rod is then threaded to the pumping equipment or another rod that has been previously set into the wellbore. Now attached to the equipment or rod(s) below, the newly-attached rod is lowered to the top of the wellbore and the process is repeated until the desired depth is reached.

The conventional method of tailing rods in uses two crew members to support the weight of the rod while walking from the storage area over the ground surface and possibly up steps onto the rig floor to the wellbore. A significant amount of stress is induced onto the rod when it is held in a non-vertical position and not properly supported, allowing it to bend or bow. The conventional method of carrying the rods to or from the wellbore results in the unsupported bending or bowing of the rods. Additional fatigue to the rods is common when the rods are not appropriately supported while being stored. Proper storage of the rods is described in API RP 11BR (American Petroleum Institute Recommended Practice). This standard sets guidelines for how the rods should be supported to minimize stress caused by bowing or bending of an unsupported or inadequately supported rod, as well as other methods of preventing damage. Sometimes, proper supporting materials are not available at the working location or guidelines are neglected.

The same API standard applies to how the rods are stored while in transport. When rods are transported in the conventional process, they are individually moved from the ground or rack by hand to a trailer and secured to the trailer in accordance with Federal Motor Carrier Safety Administration (FMCSA) regulations. When the rods are removed from the transport trailer, they are again removed individually. Because each rod is maneuvered individually, this compounds the potential for damage.

Oil well locations are typically constructed of gravel, scoria rock or dirt, resulting in uneven and unstable walking surfaces. Additionally, the hazards of the walking area can be compounded by the well's associated equipment, piping, and the overall housekeeping habits of the rig crew. For a single trip into or out of the wellbore, and in a case in which there are 400 rods for the string, and each rod is about 25 feet (7.6 m) long, the crew member tailing the bottom of the rod would have to walk over a minimum of 3.75 miles (6.0 km) over the uneven ground surface. Moreover, when the rods are moved onto and off a transport trailer by hand, this movement requires that at least one crew member climbs onto the trailer at an elevated height to pick up or set down the rod. In the processes described above, rods are often handled individually, taking a significant amount of time; moreover, conventional practices are highly inefficient when the crew members tail rods or when they are set onto or removed from the transport trailer.

Another inefficiency observed in rod handling occurs when rods are prepared for initial installation (i.e., "prepping"). When rods are purchased, they are typically transported from the manufacturer or distributor to the well location. Rod preparation includes the cleaning of the individual rods of oils and debris created in the manufacturing process, as well as installing couplers on the ends to allow the rods to be connected together. This process is typically completed by the rig crew, taking them away from other essential tasks.

SUMMARY

In one aspect, a crate comprises a frame and first and second rod guides configured to be spaced along the frame. The first rod guide comprises a first plurality of fingers, and the second rod guide comprises a second plurality of fingers. The first and second plurality of fingers are configured to be aligned with each other to define a first rod receiving slot between two adjacent fingers of the first plurality of fingers and a second rod receiving slot between two adjacent fingers of the second plurality of fingers. The first and second rod receiving slots are configured to accept a rod from a first side of the frame. A cribbing bar has a plurality of saddles, wherein a first saddle of the plurality of saddles is aligned with the first and second rod receiving slots, and wherein the first saddle is configured to accept the rod. A shaft has opposed first and second ends, wherein the cribbing bar comprises an aperture through which the shaft is configured to extend.

In another aspect, a method of arranging a plurality of elongated rods comprises setting a plurality of T-posts on a surface, wherein each of the plurality of T-posts comprises a spreader bar and an upright post, and positioning the plurality of spreader bars substantially parallel to each other. The method comprises setting first and second cribbing bars on the surface substantially parallel to each spreader bar. The first cribbing bar comprises a first plurality of saddles and wherein the second cribbing bar comprises a second plurality of saddles. The method comprises aligning a portion of the first cribbing bar between two adjacent saddles of the first plurality of saddles with a first upright post of the plurality of T-posts and disposing a first elongated rod of the plurality of elongated rods into one of the first plurality of saddles and one of the second plurality of saddles.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views. All descriptions are applicable to like and analogous structures throughout the several embodiments, unless otherwise specified.

Figure 1A:
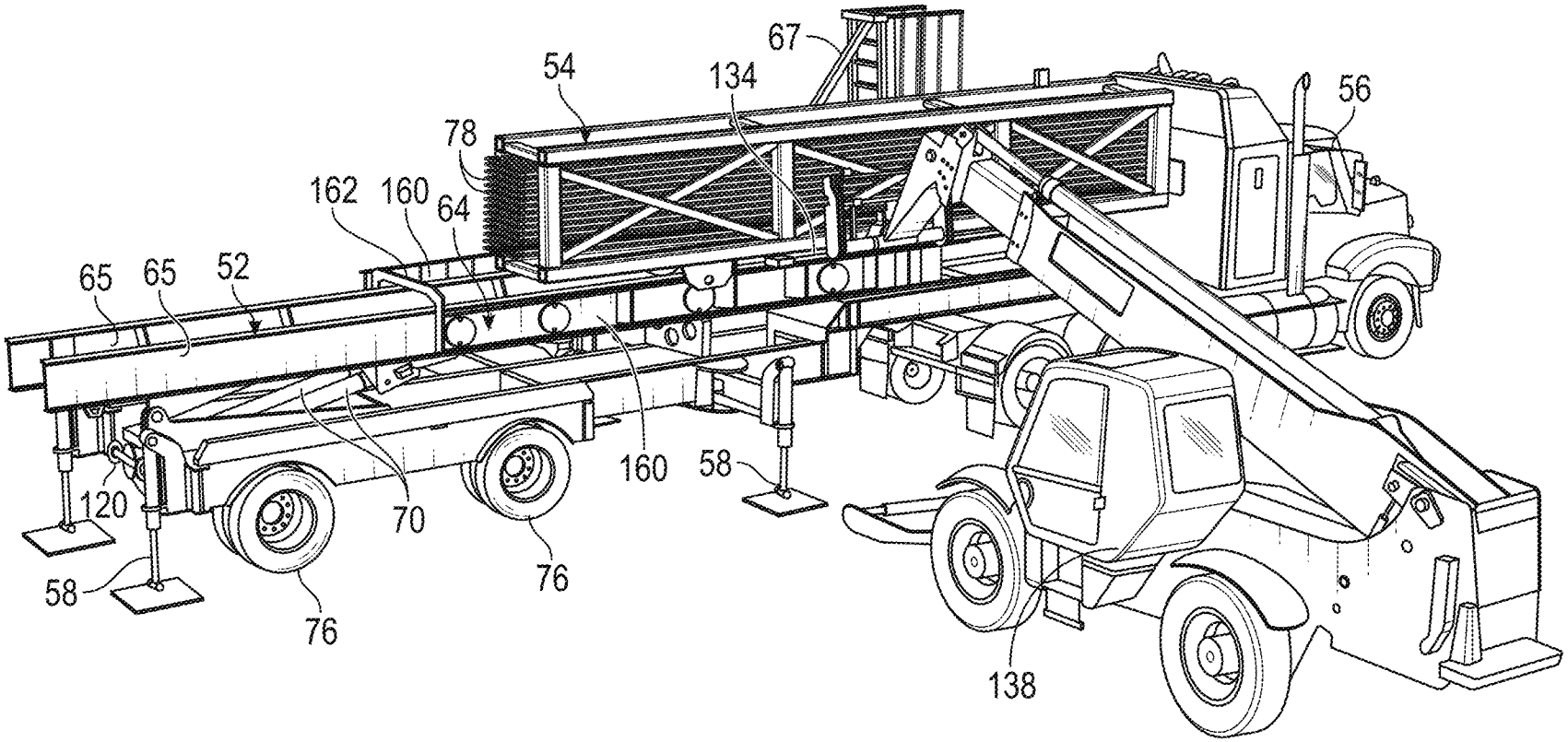
FIG. 1A is a side perspective view of a loader moving a crate onto a deployer.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art that fall within the scope of the principles of this disclosure.

The figures may not be drawn to scale. In particular, some features may be enlarged relative to other features for clarity. Moreover, where terms such as above, below, over, under, top, bottom, side, right, left, vertical, horizontal, etc., are used, it is to be understood that they are used only for ease of understanding the description. It is contemplated that structures may be oriented otherwise.

The terminology used herein is for the purpose of describing embodiments, and the terminology is not intended to be limiting. Unless indicated otherwise, ordinal numbers (e.g., first, second, third, etc.) are used to distinguish or identify different elements or steps in a group of elements or steps and do not supply a serial or numerical limitation on the elements or steps of the embodiments thereof. For example, "first," "second," and "third" elements or steps need not necessarily appear in that order, and the embodiments thereof need not necessarily be limited to three elements or steps. Unless indicated otherwise, any labels such as "left," "right," "front," "back," "top," "bottom," "forward," "reverse," "clockwise," "counter clockwise," "up," "down," or other similar terms such as "upper," "lower," "aft," "fore," "vertical," "horizontal," "proximal," "distal," "intermediate" and the like are used for convenience and are not intended to imply, for example, any particular fixed location, orientation, or direction. Instead, such labels are used to reflect, for example, relative location, orientation, or directions. The singular forms of "a," "an," and "the" include plural references unless the context clearly dictates otherwise.

DETAILED DESCRIPTION

This disclosure describes a rod crate configured for use in a system and methods of use that replace the conventional practices of installing, removing, transporting, and storing of elongated members such as sucker rods. The described apparatuses and practices improve the longevity of sucker rods, reduce worker fatigue, and create efficiencies associated with the handling of sucker rods in the oil field industry.

Increasing the longevity of rods is achieved by limiting the stress or damage induced during the rod installation and removal processes. The described system and methods significantly reduce stress by providing proper support and storage of the rods in a rod crate as they are installed and removed from the wellbore, as well as during storage and transport. The described methods eliminate the conventional practice of tailing rods and allows the process of up righting and laying down rods to be completed without stressing the rod and while providing continuous proper support.

The system includes a crate that can be used with or without the described deployer during a rod installation, removal, transportation and storage process. The crate and deployer can be set proximate a wellbore, where the rods are hung vertically as they would be in the wellbore; thus, by design, the rods do not bend or bow. This orientation removes the stresses associated with the conventional method of tailing the rods. When the rods are stored, the crate is articulated into a horizontal position, in which the rods are in the horizontal position as well. The crate is designed to provide the proper support as outlined in API RP 11BR while the rods are in a horizontal, vertical, or any orientation in between. The crate is further designed to secure the rods as they are moved, such as during articulation or transportation. In the drawings, the crate 54 is commonly shown empty (without rods 78 therein) so that its structure is more clearly visible. However, it is to be understood that in many stages of use, crate 54 will be partially or fully filled with rods 78.

Rod installation uses an elevated worker on a platform to move individual rods from the crate under the power of an air actuated lift cylinder line to the rig's lifting equipment. The rod is then lowered to above the wellbore, where its bottom end is screwed to another rod previously installed or to pumping equipment. The process of screwing the rods together or to the pump is the same process as previously described in the conventional process. For rod removal from the wellbore, the elevated worker removes the top of the rod from the rig's lifting equipment using the associated lifting cylinder and places the rod into the crate. The process is repeated until all the rods are removed from the wellbore. Since the workers do not tail rods across a ground surface, worker fatigue and the time associated with a tailing process are greatly reduced.

In an exemplary embodiment, many rods can be moved at once with powered equipment such as a loader having wheels or a ground-engaging track. The crate is equipped with stake pockets to receive tines of a loader, allowing the wheeled loader to lift a crate (whether loaded with rods or not) and either move it around the location or onto a transport trailer or deployer. For example, a full crate of rods can be moved by the loader to a nearby location, or moved by the loader to a transport trailer for longer distance moves. The crates are designed to fit onto a typical flatbed trailer and is easily secured to it following FMCSA requirements. Once on the trailer, a worker can easily secure a crate to the trailer.

Another efficiency gain is seen in the rod preparation process. Instead of transporting the rods to the well location, the system allows the crated rods to be shipped to an alternate location, where they can be processed by another party. This allows the preparation to be completed while the rig crew is completing other essential tasks, resulting in less rig downtime and reduced labor costs of the rig crew.

Figure 1B:
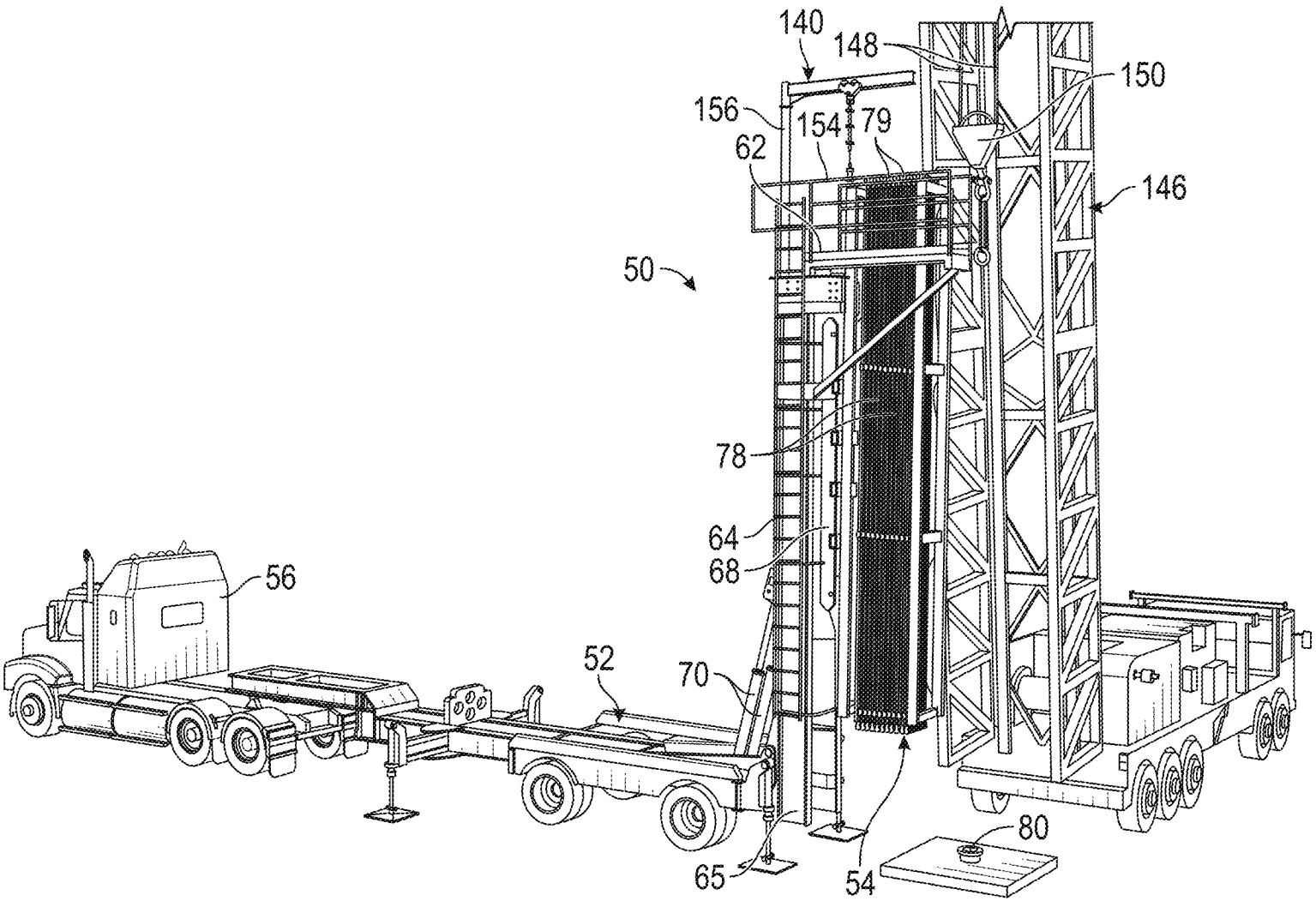
FIG. 1B is a perspective view of the deployer with the rod crate in a vertical position, and wherein the deployer is positioned for use with a workover rig at a wellbore.

As shown in FIGS. 1A and 1B, an exemplary rod handling system 50 includes two equipment elements: a deployer 52 and an associated rod crate 54. In an exemplary embodiment, deployer 52 is configured as a trailer designed to travel over the road, towed by a semi-trailer truck 56, to a well bore 80. Deployer 52 in an exemplary embodiment has outriggers 58, working platform 62, crate support frame 64 with crate support rails 65 and crate attachment bracket 68, platform brace 67, dual hydraulic lift cylinders 70 and ground engaging wheels 76.

The rod crate 54 is designed to securely hold many rods 78 simultaneously, whether in a vertical position as shown in FIG. 1B; a horizontal position as shown in FIG. 1A; or an intermediate position during the actuation of lift cylinders 70. Mast lock 120 is provided to lock the deployer 52 in a vertical position shown in FIG. 1B. Details regarding operation and structure of the deployer 52 and rod crate 54 are provided in commonly owned U.S. Pat. No. 11,661,803, entitled "Rod Handling System," which is hereby incorporated by reference. Rod crate 54 provides support along the length of the rods 78, thereby minimizing stress and potential damage to the rods 78. In an exemplary embodiment, crate 54 is a steel structure, approximately 24 feet (7.3 m) by 4 feet (1.2 m) by 3 feet (0.9 m) and is configured to be used in the vertical position (24 feet (7.3 m) in height; see FIG. 1B) during rod installation or removal from the wellbore 80 and in the horizontal position (4 feet (1.2 m) in height; see FIG. 1A) when the rods 78 are to be stored or transported. Thus, in one embodiment, the length of crate 54 is sufficient to hold many single rods 78. In the vertical position, the rods 78 hang side-by-side, as shown in FIG. 1B. In the horizontal position, as shown in FIG. 1A, the rods 78 lay side-by-side, wherein rows of rods are aligned by rod guides 84 and cribbing bars 166. In the vertical position, as shown in FIG. 1B, the rods 78 hang by a top rod guide 84 and are spaced by intermediate and bottom rod guides 84. While exemplary embodiments of crate 54 are described, it is contemplated that different dimensions and capacities can be provided to accommodate various rod diameter sizes and numbers of rods. Moreover, other materials can also be used.

Figure 2A:
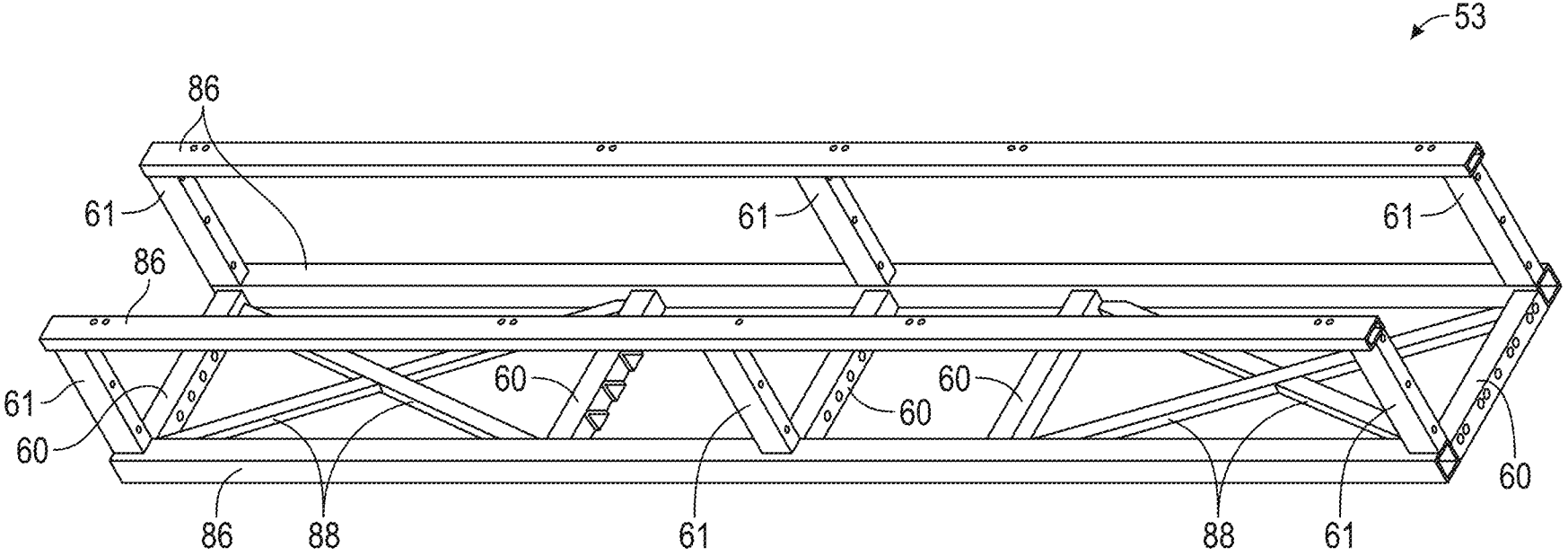
FIG. 2A is a perspective view of an exemplary rod crate frame.

FIG. 2A is a top perspective view of an exemplary crate frame 53. In an exemplary embodiment, crate frame 53 includes a plurality of elongated frame members 86 connected to each other in a three-sided block configuration. In an exemplary embodiment, braces 88 are provided on one side of the crate frame 53. A top side of the crate frame 53 as illustrated, which is opposite the braced side, remains open for the insertion of rods 78.

Figure 2B:
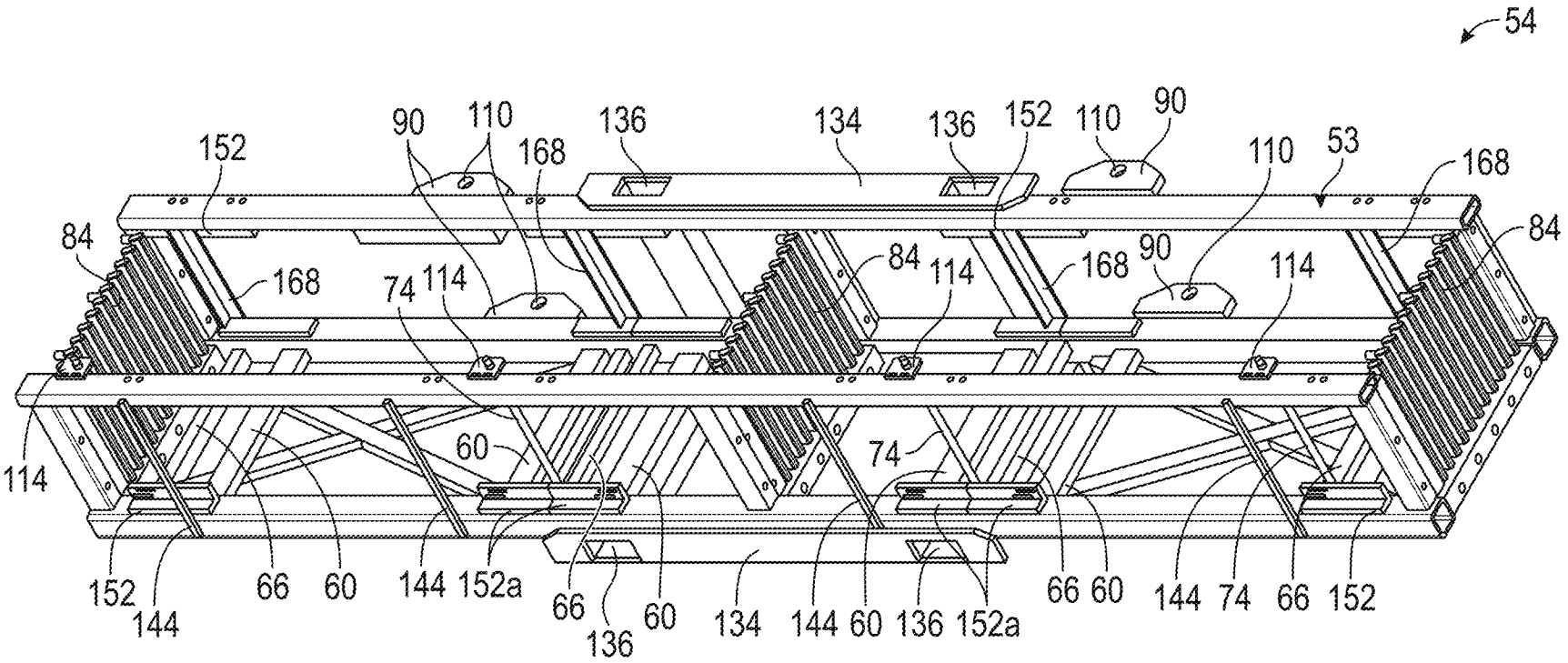
FIG. 2B is a perspective view of an exemplary rod crate.

As shown in FIG. 2B, in an exemplary embodiment, the crate 54 features four pin receivers 90 that allow the crate 54 to be detachably secured to the deployer 52 (see FIG. 1A). In an exemplary embodiment, the pin receiver 90 is configured as a flange or plate having a heavily reinforced port 110 into which a large pin can be set. The pin is part of a crate lock of the deployer 52, thereby securing the crate 54 to the deployer 52.

In an exemplary embodiment, crates 54 are designed to allow multiple such crates 54 to be stacked one on top of another (when disposed in a horizontal position) to help minimize storage footprint requirements. In some embodiments, additional bracing members 88 can be attached to the top side of crate 54 after it is filled with rods 78. As shown in FIGS. 1A and 2B, in an exemplary embodiment, crate 54 includes loader lift base 134 having fork pockets 136. The base 134 is provided in the form of two parallel flanges connected by tube pockets 136 configured to accept the tines of a fork lift type loader 138 such as shown in FIG. 1A. A crate 54, whether empty or partially or fully filled with rods 78, can be easily lifted and moved using the loader 138. Thus, an entire crate 54 of rods can be simultaneously moved from a storage area or onto the deployer 52 under mechanical means. As shown in an exemplary embodiment in FIG. 2B, a base 134 can be provided on two or more sides of frame 53 so that crate 54 can be lifted in more than one orientation.

An exemplary deployer 52 includes equipment that allows the crate 54 to be articulated between the horizontal and vertical positions (such as dual hydraulic lift cylinders 70); an elevated working platform 62 on which a crew member may stand to move rods to and from the crate 54 when in the vertical position; a built-in ladder by which to access the platform 62; a hydraulic scoping slide or cylinder to raise and lower the crate 54 into the proper position for sucker rod deployment or collection; as well as outriggers 58 to help stabilize the system 50 when the crate 54 is in motion or in the vertical position. Additionally, the deployer 52 can be equipped with a jib crane 140 and an associated lift cylinder mounted on a trolley; these components can be used by the worker standing on platform 62 to transfer individual rods 78 into and out of the crate 54 at the well bore 80.

In the illustrations, and in particular in FIG. 1B, workers are not shown so that the system components are more easily viewed. However, it is to be understood that in a typical method of use, a semi-trailer driver moves system 50 into position near the wellbore 80 and workover rig 146. A proper position allows an elevated worker standing on working platform 62 to reach the rig's lifting equipment. Once the deployer 52 is in the final position, the forward and rear outriggers 58 are rotated outward and hydraulically extended downward; these actions level, support and stabilize the system 50, such as to prevent it from tipping over under working weight, forces incurred while installing or removing rods, and wind forces.

Drill lines 148 of the workover rig 146 carry traveling block 150, which is designed to latch onto the top ends of rods 78 to lift them up and down (out of and into) the wellbore 80. During rod insertion or extraction operations, the system 50 is positioned so that a worker standing on platform 62 can reach a traveling block 150 as it is raised by the drill lines 148 in order to either remove a rod 78 attached to the traveling block 150 or attach a rod 78 to an empty traveling block 150. Once on the platform 62, the crew member secures him/herself to the deployer 52 using appropriate fall protection equipment that can be attached to railing 154, for example. The platform 62 is designed for the elevated worker to be able reach rods 78 that are elevated to him by the workover rig 146 and also to reach into the farthest points of the crate 54 to and from which he will be transferring the rods 78 in or out.

Depending on the task at hand, rods 78 can be transferred from the workover rig 146 into the crate 54 or from the crate 54 to the workover rig 146 using mechanical means and minimal human physical effort. The support 156 for the jib crane 140 extends above the platform 62. The support 156 and/or jib crane 140 can be rotated in the horizontal plane to position the jib crane 140 at a convenient location for the worker.

In an exemplary embodiment as shown in FIG. 2A, the crate frame 53 is of a universal design, and differently configured rod guides 84 (see FIG. 3A) can be attached to the crate frame 53 to form a rod crate 54 (see FIG. 2B) that can accommodate many different sizes (diameters) and numbers of sucker rods 78 or other elongated items. Having removable and replaceable rod guides 84 also allows for repair and replacement of damaged rod guides as needed. For example, a surface coating on the guide fingers 92 designed to provide abrasion resistance can be recoated once the wearable surface is worn. In the rod crate 54 illustrated in FIG. 2B, three rod guides 84 are used, along with four cribbing assemblies 66. However, different numbers of such structures can be used in rod crates than illustrated. In an exemplary embodiment, each of the rod guides 84 is attached to frame 53 at a location of two side bars 61 and cross bar 60. As shown in FIG. 2B, additional cross bars 60 can be added to crate frame 53 to provide for additional mounting positions for cribbing assemblies 66.

Figure 2C:
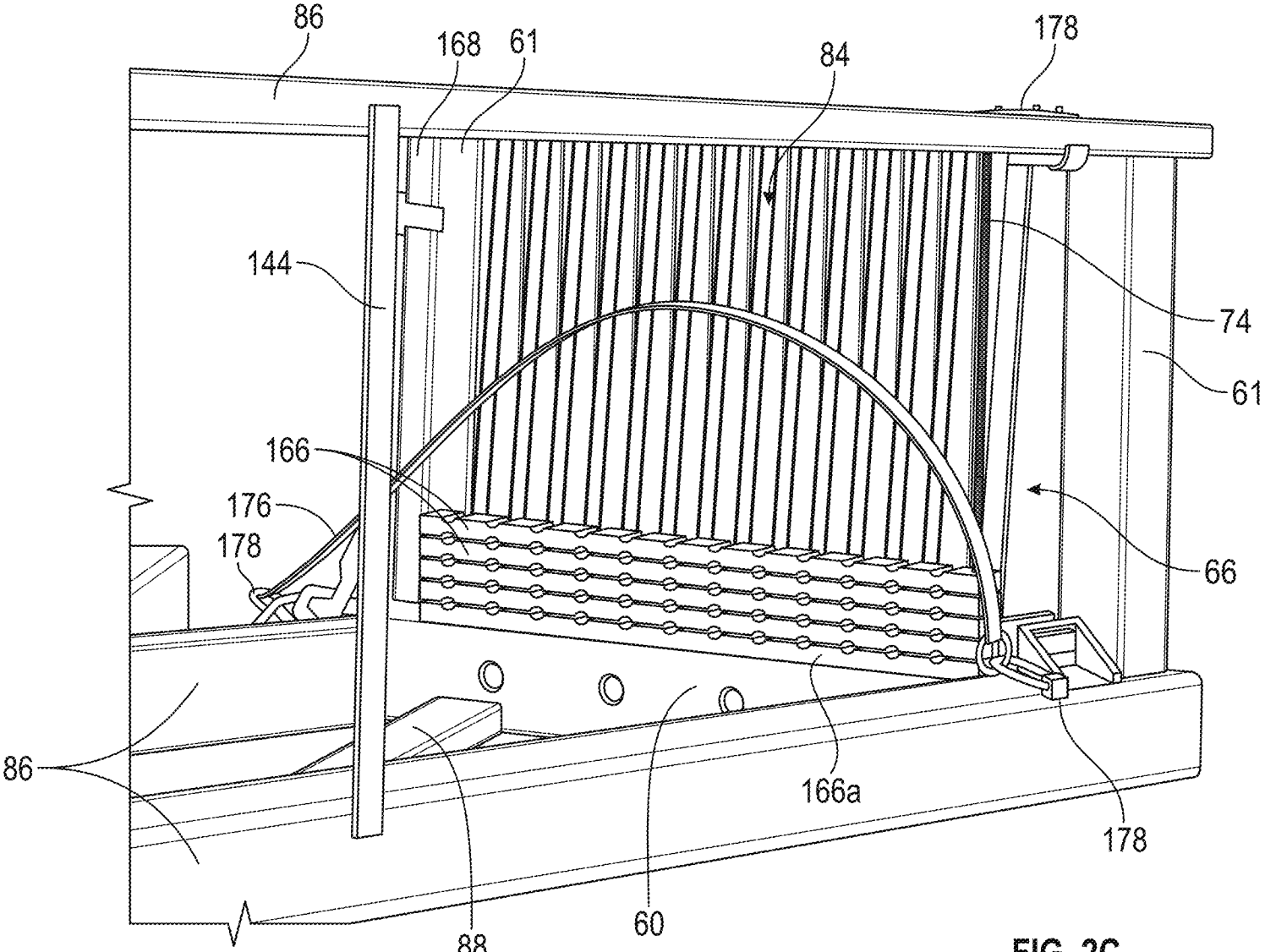
FIG. 2C is a perspective view of one end of the rod crate with a rod restraint strap (rods are not shown).

FIG. 2C is a perspective view of a right end of a rod crate 54 with a rod restraint strap 176 (rods are not shown). Latches 178, which can be as simple as D-rings, are attached to frame members 86. In use, rods 78 are inserted into rod guide 84 from the top of the view of FIG. 2C. A row of rods is laid into the saddles of base cribbing bar 166*a*, and then the next cribbing bar 166 is slid down shaft 74 while supported on cribbing guide 168 to lay over the row of rods. Thus, the two cribbing bars 166, 166*a* on either side of the row of rods maintain spacing between adjacent rods equal to the spacing between adjacent saddles of the cribbing bars 166, 166*a*. In a case when it is desirable to move a partially filled crate 54 of rods, the strap 176 is pulled against the last row of rods and tightened between latches 178 to hold the rod load against the bottom or rear (braced with 88) side of the crate 54. With such strap assemblies spaced along a length of crate 54, the rods of even a partially filled crate are held securely during crate motion. When not in use, the strap 176 can be disconnected from one or both sides of the crate 54 and stored.

Figure 3A:
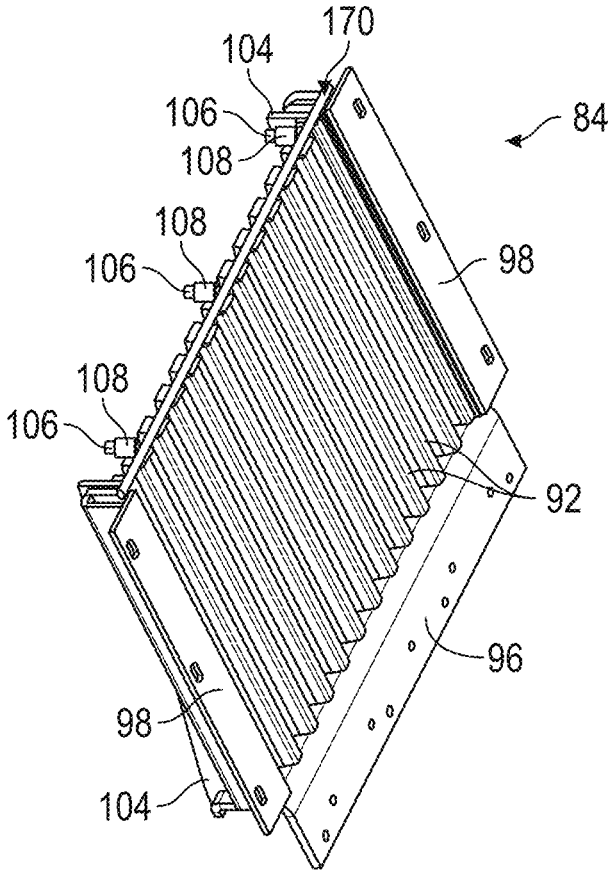
FIG. 3A is a perspective view of an exemplary rod guide.
Figure 3B:
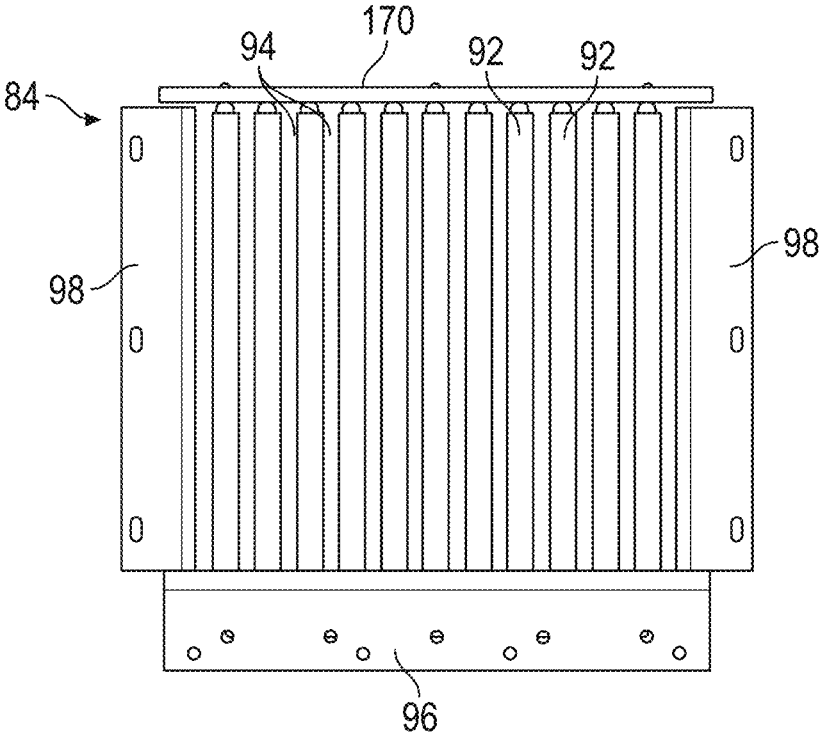
FIG. 3B is a plan view of the rod guide.
Figure 6:
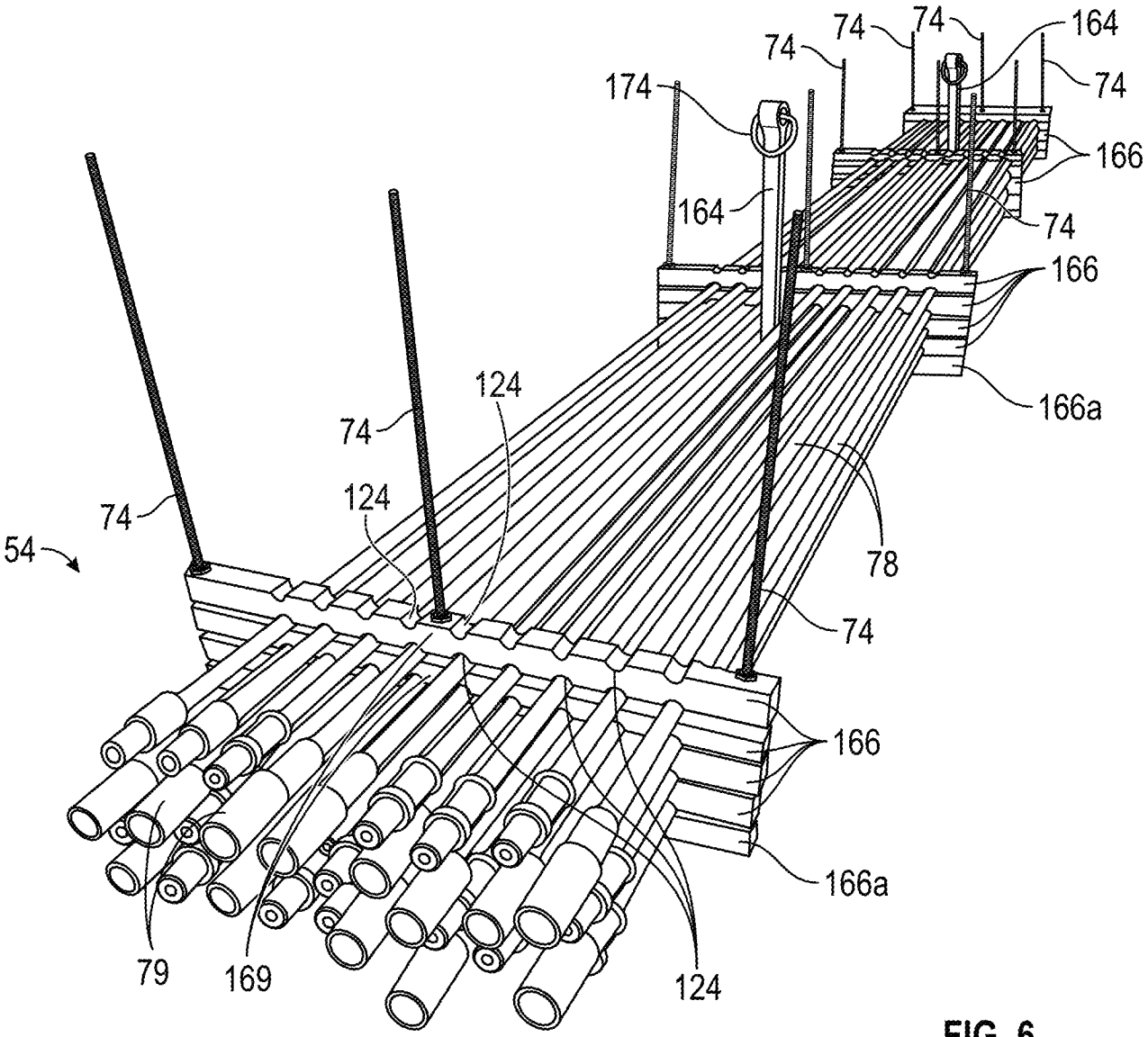
FIG. 6 is a partial perspective view of an assembly of a plurality of rods secured between a plurality of cribbing bars.

FIG. 3A is a perspective view of an exemplary rod guide 84, which is disposed at each end of crate 54 and one or more intermediate locations. FIG. 3B is a plan view of the rod guide 84. In an exemplary embodiment, rod guide 84 includes a back frame member 96 and two side frame members 98. FIG. 3H shows the plurality of support fingers 92 removed from the back frame member 96 and two end support finger portions 100 removed from the side frame members 98. In an exemplary embodiment, each of support fingers 92 and end support finger portions 100 has a greater height dimension near the back end thereof compared to the front end thereof. Thus, a strong attachment of support fingers 92 to back frame member 96 is provided while allowing for savings in materials and weight at the open, cantilevered front end. As shown in FIG. 6, each of the rods 78 has an enlarged end 79 that is wider than gap 94 between guide fingers 92. In a vertical crate orientation as shown in FIG. 1B, rods 78 hang by their ends 79 from the fingers 92 of rod guide 84. In an exemplary embodiment, each of the support fingers 92 at its front end includes a protrusion 102 to prevent unintentional sliding of a rod 78 out of the open front end, as ends 79 will be held by protrusions 102.

In an exemplary embodiment, rod crate 54 has rod guides 84 positioned so that the slot pockets 94 are aligned for the receipt of rods 78 that span across at least two of the rod guides 84 and more likely all of the rod guides 84. The rod guides 84 are strategically positioned to provide support as outlined by API RP 11BR while the rods 78 are in the horizontal position, such as while being stored or while in transit. Exemplary embodiments of crate 54 are capable of securely storing and protecting about 11 to 15 rows of rods, or between about 132 and 195 rods, depending on the rod size or configuration of rod guides 84.

In an exemplary embodiment, slot pockets 94 are closely dimensioned to hold the tops 79 of rods 78 in a hanging configuration, as shown in FIG. 1B, for example. The precise placement of the tops 79 of rods 78 on rod guide 84 allow for careful alignment of the rods 78. Moreover, the use of cribbing bars 166 across each row of filled rods (see FIGS. 6 and 9-11), wherein a row is perpendicular to a slot pocket 94, spaces each of the plurality of rods 78 from the other rods. A portion of each of rods 78 is received into a slot pocket 94 of a rod guide 84 and also into saddles 124 of two adjacent cribbing bars 166, 166*a*. The slot pockets 94 are dimensioned to allow for ease of insertion and support of the rods 78 between guide fingers 92.

Figure 3C:
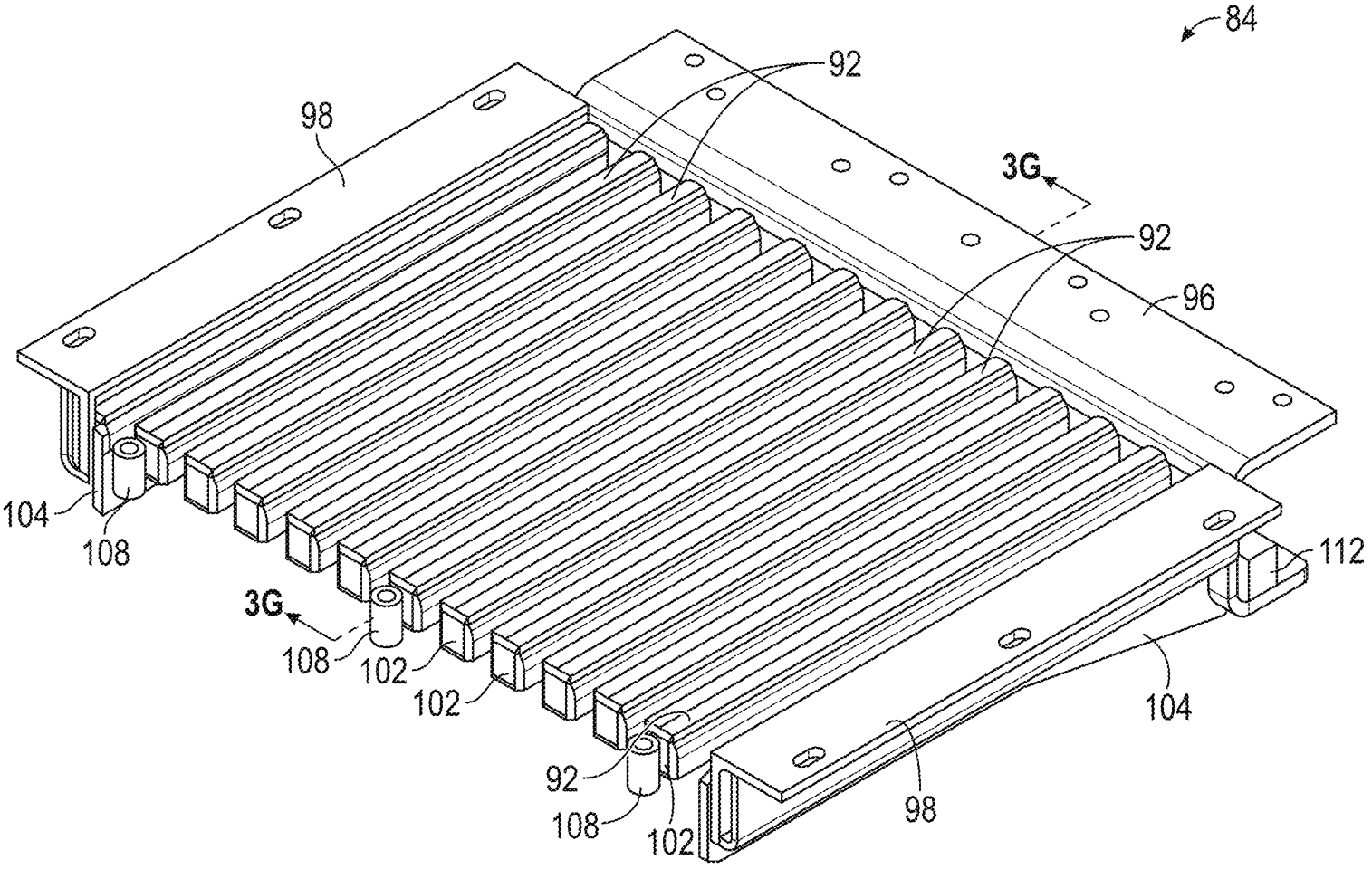
FIG. 3C is a perspective view of the rod guide with the lock bar removed from its brackets.
Figure 3D:
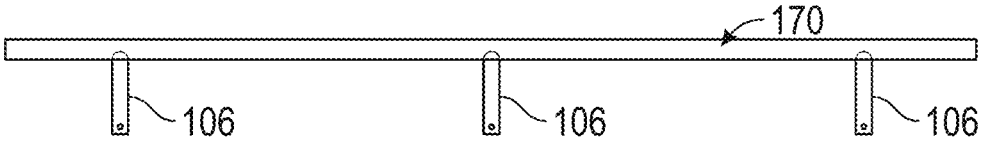
FIG. 3D is a side elevation view of the removed lock bar.
Figure 3E:
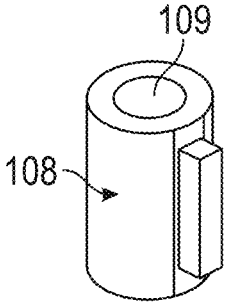
FIG. 3E is an enlarged perspective view of a bracket for the lock bar peg.
Figure 3F:
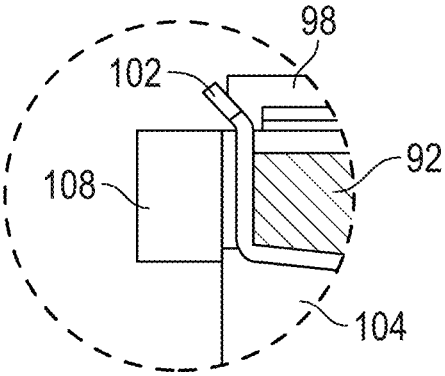
FIG. 3F is a partial side cross-sectional view of a front portion of the rod guide, taken at the encircled portion "3F" of FIG. 3G.
Figure 3G:
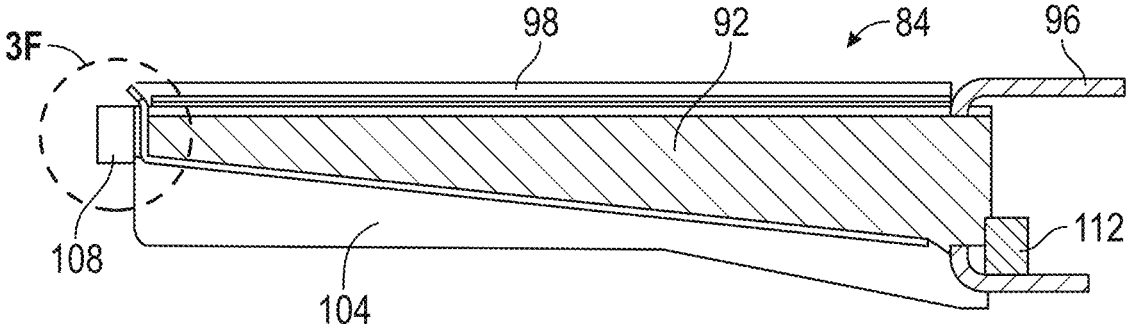
FIG. 3G is a cross-sectional view, taken at line 3G-3G of FIG. 3C.
Figure 3H:
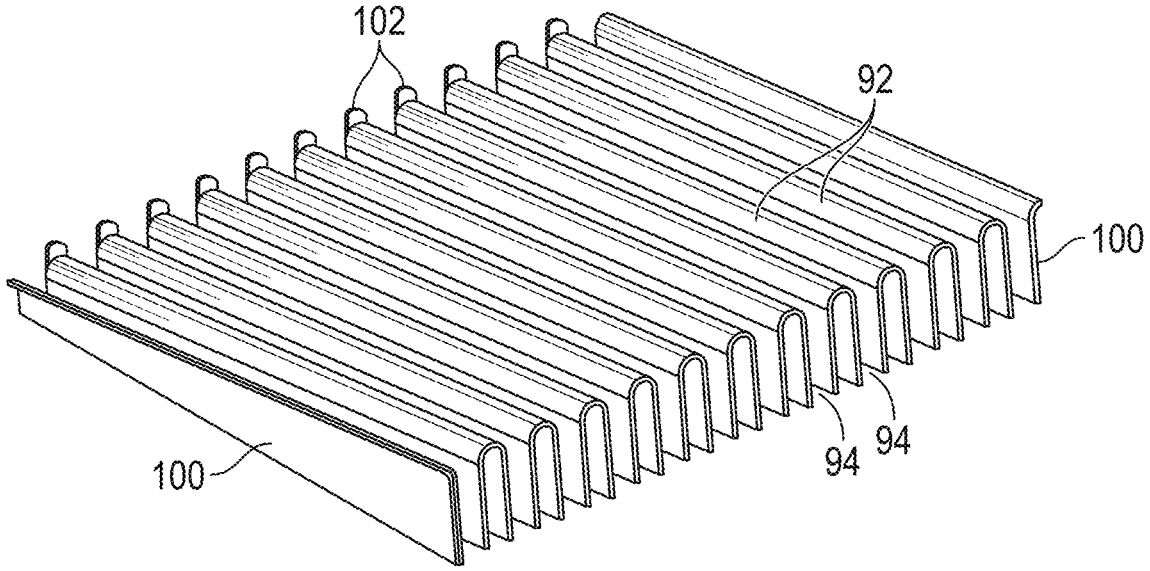
FIG. 3H is a perspective view of the guide finger assembly removed from the frame members.

As shown in the embodiment of FIGS. 3A-3H, in an exemplary embodiment, there are eleven support fingers 92 and two end support finger portions 100, creating twelve slot pockets 94 therebetween, each about 1 inch wide, into which the rods 78 may be slid. In an exemplary embodiment, each of the slot pockets 94 has a capacity of about fifteen rods. When the crate 54 is partially filled with rods 78, the partial load can be secured with restraint strap 176, as discussed with reference to FIG. 2C. When the crate 54 is ready to be moved, each rod guide 84 can be secured with lock bars 170. In an exemplary embodiment, lock bars 170 are installed on the open side of crate 54, opposite back frame member 96. Installing locks bars 170 prevents the rods 78 from sliding out, especially when crate 54 is in motion, such as when the crate 54 is being transported or articulated either to the horizontal or vertical position. As shown in FIGS. 3C and 3D, lock bar 170 has been removed from the rod guide 84 by lifting its pegs 106 (vertically upward as depicted) out of apertures 109 of brackets 108. When a lock bar 170 is installed onto the rod guide 84, it prevents rods 78 from sliding out the open insertion end of a rod guide 84.

FIG. 3E is a perspective view of an exemplary embodiment of bracket 108, which is welded to protrusions 102 of selected guide fingers 92, as shown in FIGS. 3C-3F, to be aligned with the pegs 106 of lock bar 170. In an exemplary embodiment, a bore 109 of bracket 108 is configured for the insertion of peg 106. In an exemplary embodiment of rod guide 84, structural reinforcement side plates 104 are positioned at each side of the guide 84 between side frame member 98 and end guide finger portion 100. In an exemplary embodiment, at the back frame member 96, steel reinforcement bar 112 is positioned proximate the crate frame 53.

Figure 4A:
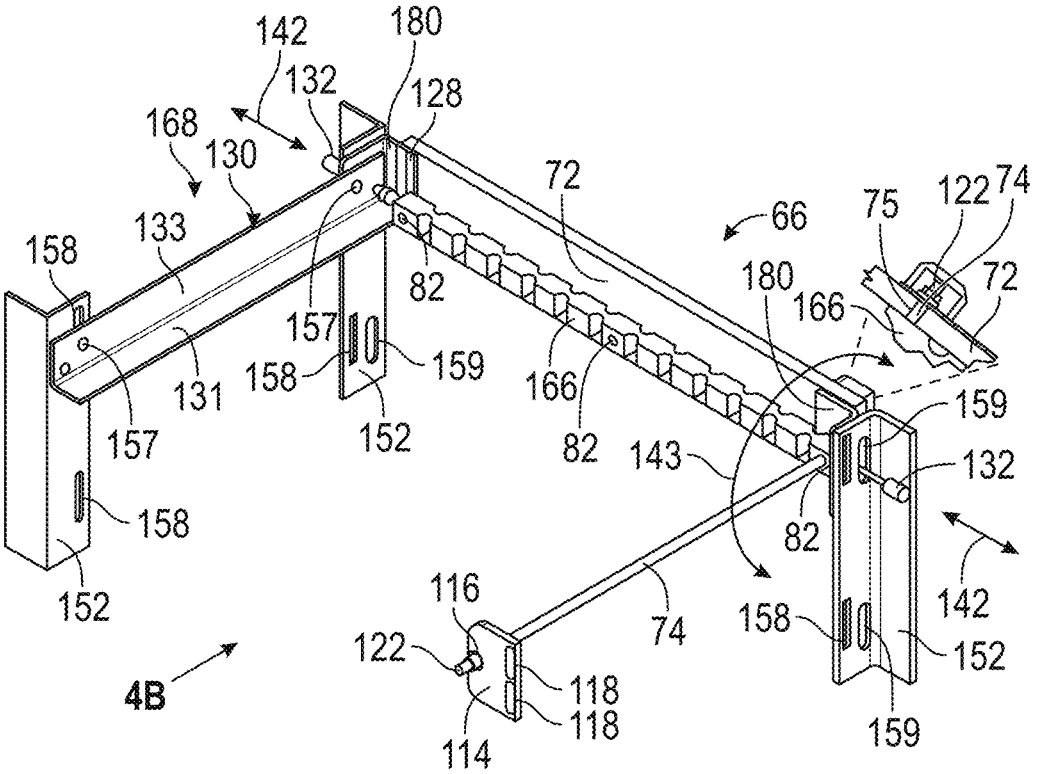
FIG. 4A is a perspective view of a cribbing assembly.
Figure 4B:
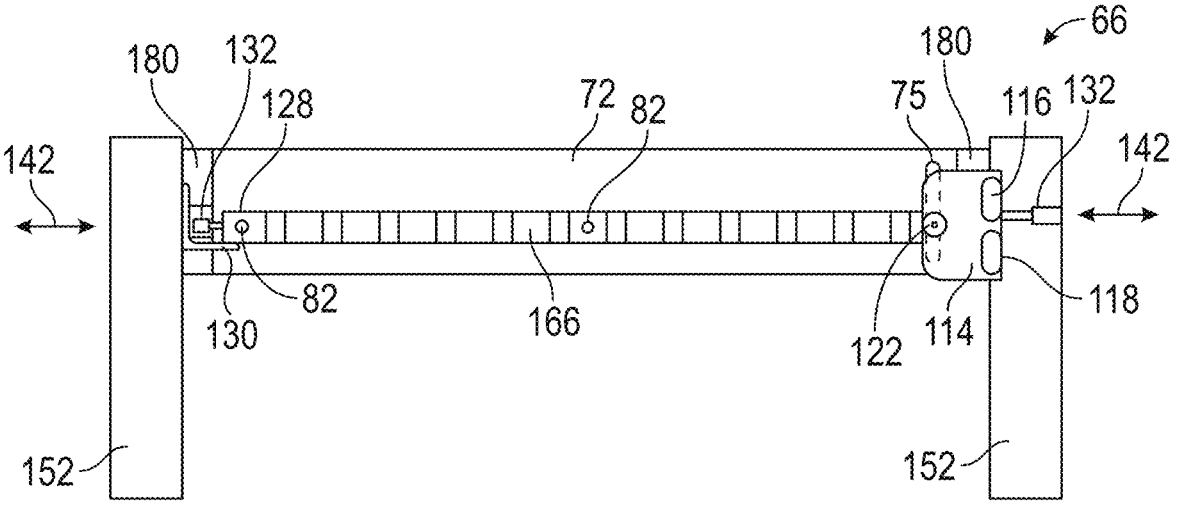
FIG. 4B is an elevation view of the cribbing assembly, as viewed from vantage point "4B" of FIG. 4A.
Figure 4C:
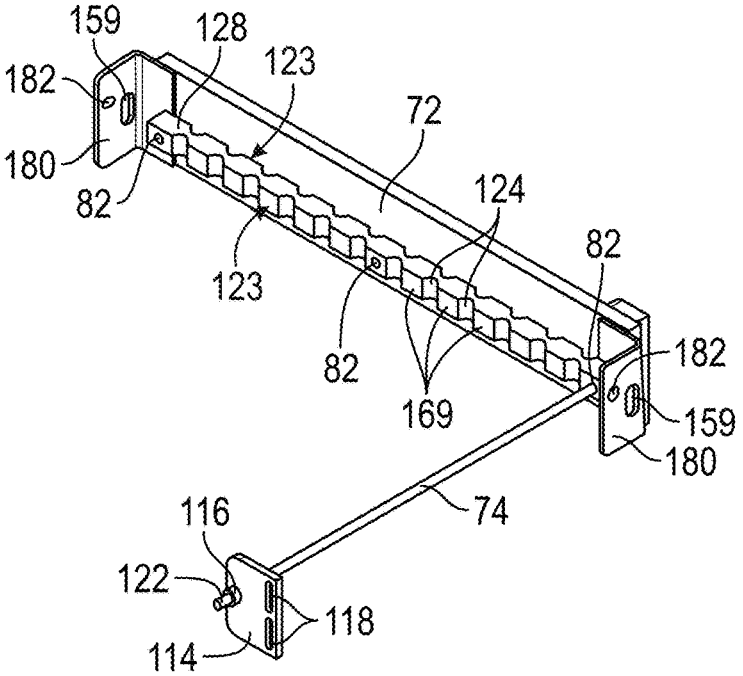
FIG. 4C is a perspective view of an exemplary body cribbing bar attached to a rear plate by a shaft.
Figure 4D:
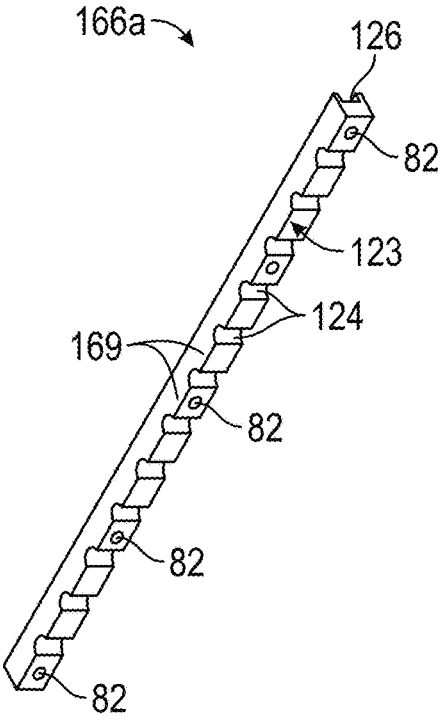
FIG. 4D is a perspective view of an exemplary base cribbing bar.
Figure 4E:
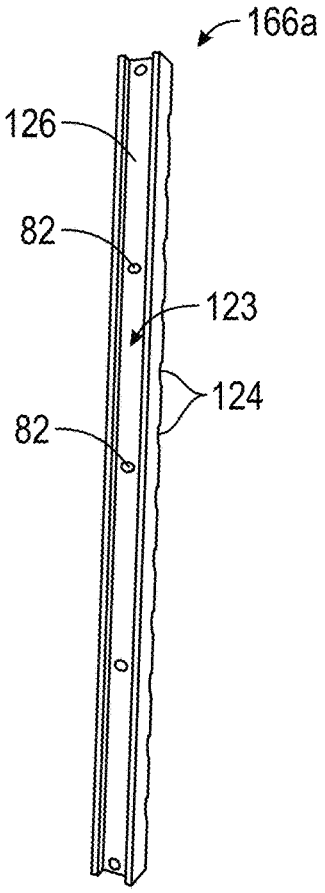
FIG. 4E is a rear perspective view of the exemplary base cribbing bar.
Figure 5A:
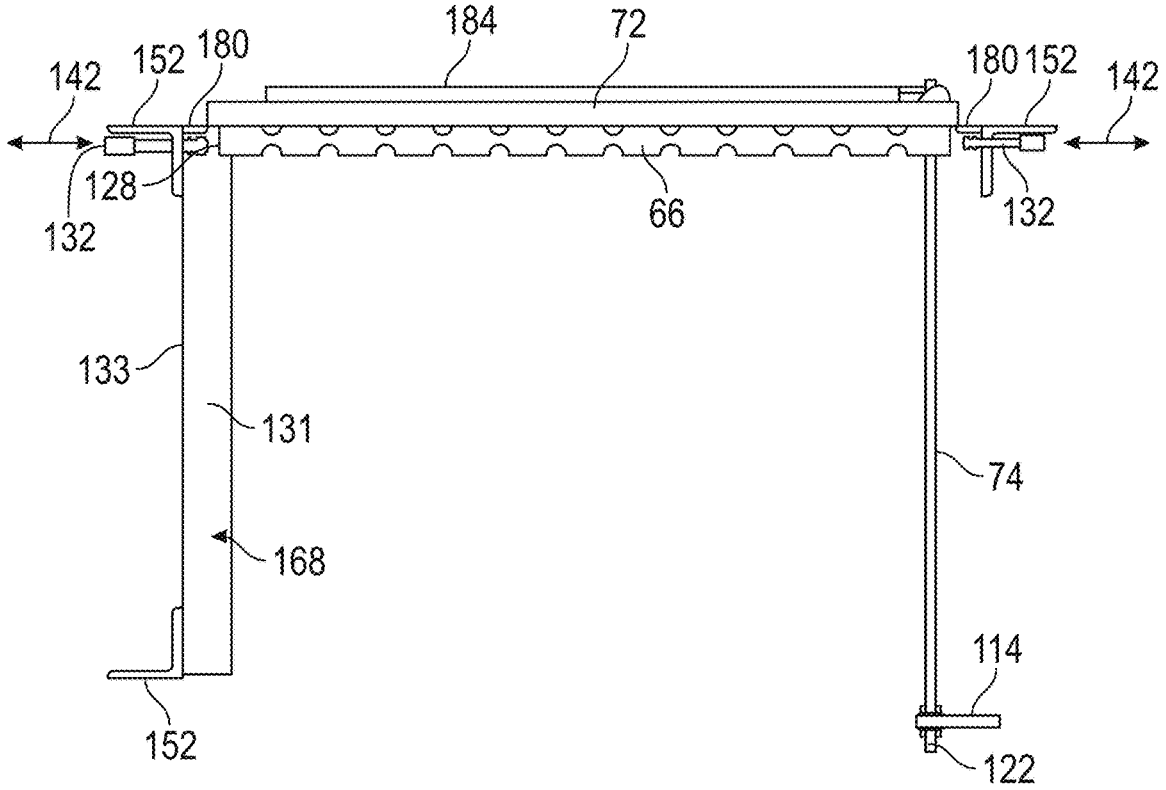
FIG. 5A is a plan view of an exemplary cribbing assembly of FIG. 4A.
Figure 5B:
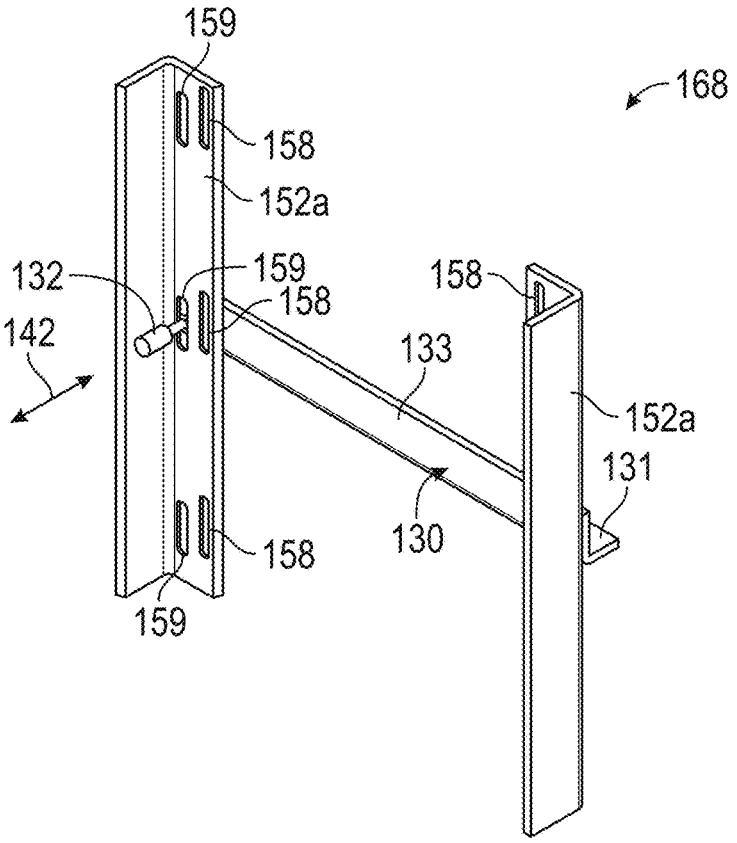
FIG. 5B is a perspective view of an exemplary cribbing support bracket from the opposite side than shown in FIG. 4A.

FIG. 4A is a perspective view of a cribbing assembly 66 that is optionally attached to the crate frame 53 (see FIG. 2B). FIG. 4B is an elevation view of the cribbing assembly 66, as viewed from vantage point "4B" of FIG. 4A. FIG. 4C is a perspective view of an exemplary body cribbing bar 166 attached to a rear plate 72 by a shaft 74. FIG. 4D is a perspective view of an exemplary base cribbing bar 166*a*. FIG. 4E is a rear perspective view of the exemplary base cribbing bar 166*b*. FIG. 5A is a plan view of an exemplary cribbing assembly 66 of FIG. 4A. FIG. 5B is a perspective view of an exemplary cribbing support bracket 168 from the opposite side than shown in FIG. 4A.

In an exemplary embodiment, cribbing assembly 66 includes rear plate 72 configured to be positioned against cross bar 60. In an exemplary embodiment, one or more threaded shafts 74 extends generally perpendicularly from the rear plate 72. As shown in FIG. 4B, in an exemplary embodiment, elongated slot 75 allows for adjustability in the position of the shaft 74 relative to the plate 72, in order to facilitate alignment of the cribbing bar 166. Cribbing bar 166 has one or more apertures 82 through which shaft 74 extends. In an exemplary embodiment, front plate 114 is configured with an aperture 116 through which the shaft 74 passes, as well as apertures 118 by which the front plate 114 is fixable to an exterior face of elongated frame member 86 (see FIGS. 10A and 11). Fastener assemblies 122 are provided at each end of the shaft 74 to secure the shaft to rear plate 72 and front plate 114. Fastener assemblies 122 can include any known fasteners, such as nuts and bolts, for example.

Figure 11:
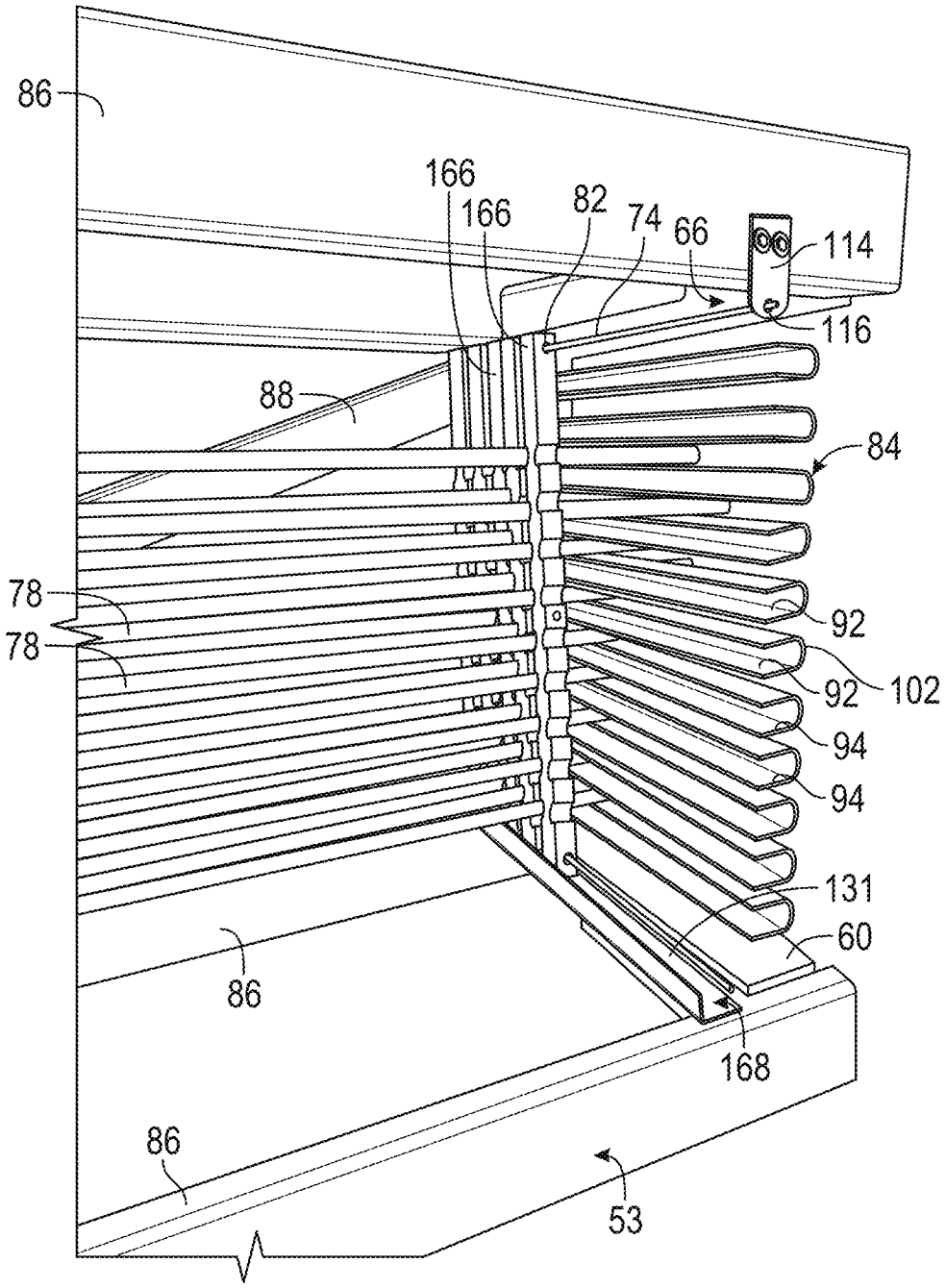
FIG. 11 shows a plate secured to the cribbing shaft to maintain an end position of the cribbing shaft.

FIG. 5A is a top plan view of the cribbing assembly 66 positioned proximate cribbing guide 168, which is configured to support the free end 128 of cribbing bar 166. FIG. 11 is a partial perspective view of a crate 54, partially filled with rods 78. The rods 78 in slots 94 are separated by cribbing bars 166, which are placed perpendicular to the fingers 92. In an exemplary embodiment, cribbing guides 168 are attached to crate frame 53 near each rod guide 84 to support cribbing bars 166. Cribbing bars 166 are installed to prevent adjacent rods 78 from touching each other. Cribbing bars 166 space the rods 78 apart, with each rod 78 in its individual saddle 124, preventing them from touching and rubbing together while in transit. This can reduce physical damage and material fatigue in the rods 78.

In an exemplary embodiment, cribbing guide 168 is configured as a right angle member 130 having right angle legs 131 and 133. In an exemplary embodiment, cribbing bar 166 rests upon the leg 131 of the right-angle member 130. Moreover, an end of adjustment bolt 132 is configured to pass through leg 133 and move in reciprocal axial directions 142 to impart a compressive force against the free end 128 to maintain the cribbing bar 166 in place and in an orientation parallel to the rear plate 72, as shown in FIGS. 4A and 4B. Additional compression can similarly be imparted by adjustment bolt 132 on the pinned end of cribbing bar 166 (proximate shaft 74). Providing adjustability on both ends of cribbing bar 166 also allows a user to move the cribbing bar 166 in directions 142 to precisely align its saddles 124 with slots 94 of rod guide 84, thereby allowing a rod 78 to lie in a straight configuration in the saddles 124 and slots 94. As shown in FIG. 5A, in an exemplary embodiment, a reinforcement plate 184 is provided on the back of rear plate 72.

In an exemplary embodiment, cribbing guide 168 includes two mounting brackets 152 configured to attach the right-angle member 130 to crate frame 53. In an exemplary embodiment, elongated slots 158 allow for adjustability in the position of the fasteners 157 of right-angle member 130 relative to the mounting brackets 152. Similarly, elongated slot 159 of brackets 152, 180 allows for adjustability in the position of the adjustment bolt 132 and a respective cribbing bar 166, 166*a*.

FIG. 4C is a perspective view of an exemplary cribbing bar 166 mounted via shaft 74 on rear plate 72. In an exemplary embodiment, rear plate 72 has two end mounting brackets 180, each configured as a right angle member. As shown in FIG. 4A, on the side with cribbing guide 168, mounting bracket 180 is disposed between mounting bracket 152 and right angle member 130. In an exemplary embodiment, bracket 180 has slot 159 for adjustment bolt 132 and aperture 182 for fastener 157.

As shown in FIGS. 4A and 5B, two specific embodiments of a mounting bracket are described, and in some cases they will be differentiated by referring to the first embodiment with reference number 152 and the second embodiment with reference to number 152*a*. However, in many aspects, the mounting brackets are similar; descriptions of mounting bracket 152 or 152*a* apply to all embodiments unless otherwise specified. This convention also applies to other similarly numbered elements, such as cribbing bars 166, 166*a*. In FIG. 5B, mounting bracket 152*a* has three attachment positions for right angle member 130 at aligned slots 158, rather than the two attachment positions 158 shown on mounting bracket 152 of FIG. 4A. In both cases, with reference to FIG. 2B, these mounting brackets 152, 152*a* allow for flexibility in mounting cribbing assembly 66 along a length of rod crate 54. In an exemplary embodiment, the mounting brackets 152, 152*a* are welded to crate frame 53. However, the other components of cribbing assembly 166 are removably attachable to the mounting brackets and are thus adjustably positionable along the length of the rod crate 54.

In an exemplary embodiment, cribbing bar 166 has apertures 82 (for the passage of shaft 74) and a plurality of saddles 124 into which the rods 78 are seated. In an exemplary body cribbing bar 166, a plurality of saddles 124 is provided on each of two opposed sides of the cribbing bar 166, wherein those sides also have the apertures 82 disposed therethrough in a space between adjacent saddles 124 or to the side of an end saddle. In an exemplary embodiment, the number of saddles 124 equals the number of slot pockets 94, as each saddle 124 is configured to surround half of each rod 78 inserted into a slot pocket 94 of the rod guide 84.

At the far rear and front ends of the rod guide 84, the cribbing bar 166 can have saddles 124 disposed on only a single of the bar surfaces, as shown in the base cribbing bar 166*a* shown in FIGS. 4D and 4E. In an exemplary embodiment, a surface of the base cribbing bar 166*a* opposite the surface on which the saddles 124 are provided can be fit with a reinforcement element such as a metal bar 126, for example.

As shown in FIG. 11, a cribbing bar 166 is positioned between each row of sucker rods 78 inserted into the rod guide 84. All of the needed cribbing bars for a full rod crate 54 can be pre-deployed onto shaft 74 and pivoted out of the way (with shaft 74 being the rotation axis) until needed. As shown in FIGS. 4A-5A, when such rotation is desired, the adjustment bolt 132 is threaded to back away from the free end 128 of cribbing bar 166, 166*a* to allow its pivoting about shaft 74 in pivotal direction 143. As shown in FIG. 2B, cribbing rest bars 144 are provided on the crate 54 to support the cribbing bars 166 that are rotated about shaft 74.

As shown in FIG. 1B, in a process of tripping rods out of the wellbore, an elevated worker latches onto a top 79 of rod 78 to remove it from traveling block 150. The rod 78 is moved to a receiving slot pocket 94 between the rod guide fingers 92. The worker pushes the rod 78 into one of the slot pockets 94 to hang the rod 78 from the between aligned support fingers 92. Once a row is filled (wherein a row is perpendicular to a slot 94; for example, a row may consist of one rod in each slot 94 in contact with a cribbing bar 166), a worker installs a cribbing bar 166 for securement and to provide rod separation. Cribbing bars 166 can be installed by an operator as he or she fills the crate 54 from the back to the front (the front being the open side of the rod slots). After a crate 54 is filled with rods 78 (or the operation is otherwise completed), the worker tightens strap 176 across the last row of rods 78. Additionally or alternatively, the worker inserts the pegs 106 of lock bar 170 into substantially cylindrical brackets 108 at each rod guide 84. In an exemplary embodiment, gravity and friction hold pegs 106 in brackets 108.

The crate 54 is moved down relative to the workover rig 146 by retracting the scoping cylinder. The mast lock 120 is then disengaged. Under control of a crew member, hydraulic cylinders 70 are actuated to move the deployer 52 and the connected crate 54 back into the horizontal position. In one method, once laid back, the crate/deployer securement pins are disengaged from the crate pin receivers 90 by unlocking crate locks. The full crate 54 can then be removed using a loader 138. An empty crate 54 can then be attached to deployer 52 and locked thereto. This process is then repeated until all the rods of a rod string are removed from the well bore 80.

It is contemplated that in one method, oil field companies would utilize the crate 54 for new rods, beginning the crate filling process at the manufacturer or distributor. New rods 78 would be packaged into the crate 54, by which they would be delivered to a preparation ("prepping") location. Instead of utilizing the workover rig crew, a more economical and efficient process could be used to prepare the rods using a third party with more cost-effective labor while permitting the rig crew to complete other essential tasks simultaneously. The prepped rods 78 can then be delivered to the final worksite without taking time and resources from the workover crew members.

Figure 7:
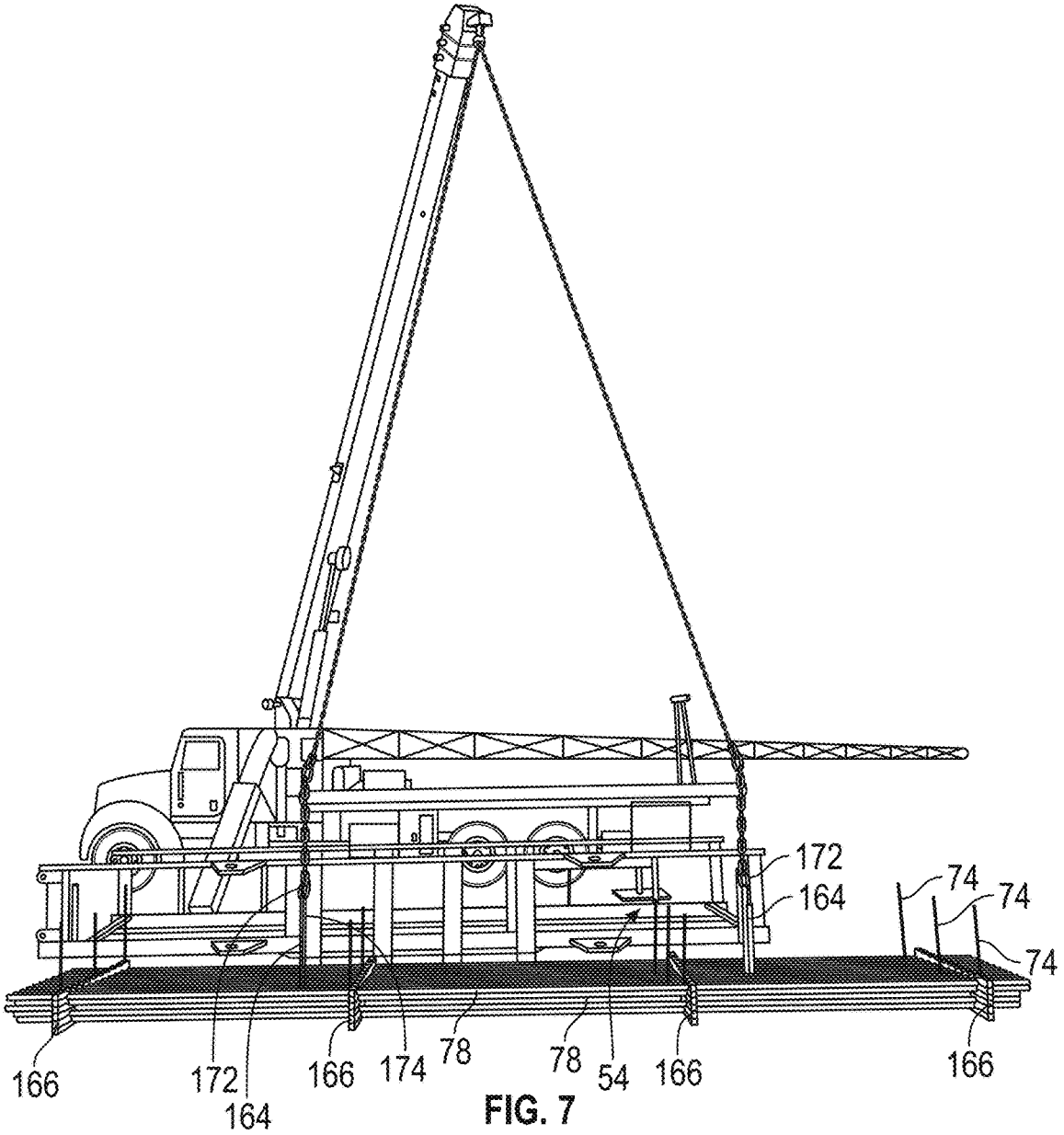
FIG. 7 is a side perspective view of the rod assembly of FIG. 6 configured to be lifted by a crane into an empty rode crate.
Figure 8:
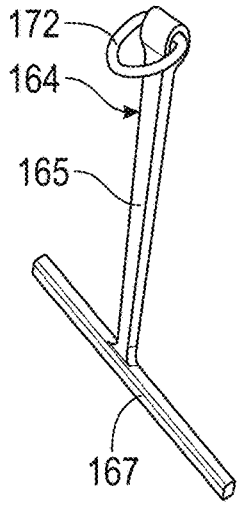
FIG. 8 is a perspective view of a T-post used to lift the rod assembly.

FIGS. 6-11 illustrate another method for filling a crate 54 with rods 78. In an exemplary embodiment, two or more T-posts 164, shown separately in FIG. 8, are positioned on the ground surface. As shown in FIGS. 6 and 7, a first layer of cribbing bars 166, 166*a* is placed on the ground substantially parallel to the spreader bar 167 of the T-posts 164. A first layer of rods 78 is placed into the saddles 124 of the cribbing bars 166, 166*a*, positioned so that the upstanding posts 165 extend between saddles 124, and thus between rods 78 that are laid into the saddles 124. Alignment shafts 74 are inserted into apertures 82 of the cribbing bars 166*a*, 166 to align them, and layers upon layers of rods 78 and cribbing bars 166 are stacked upon each other.

Figure 9:
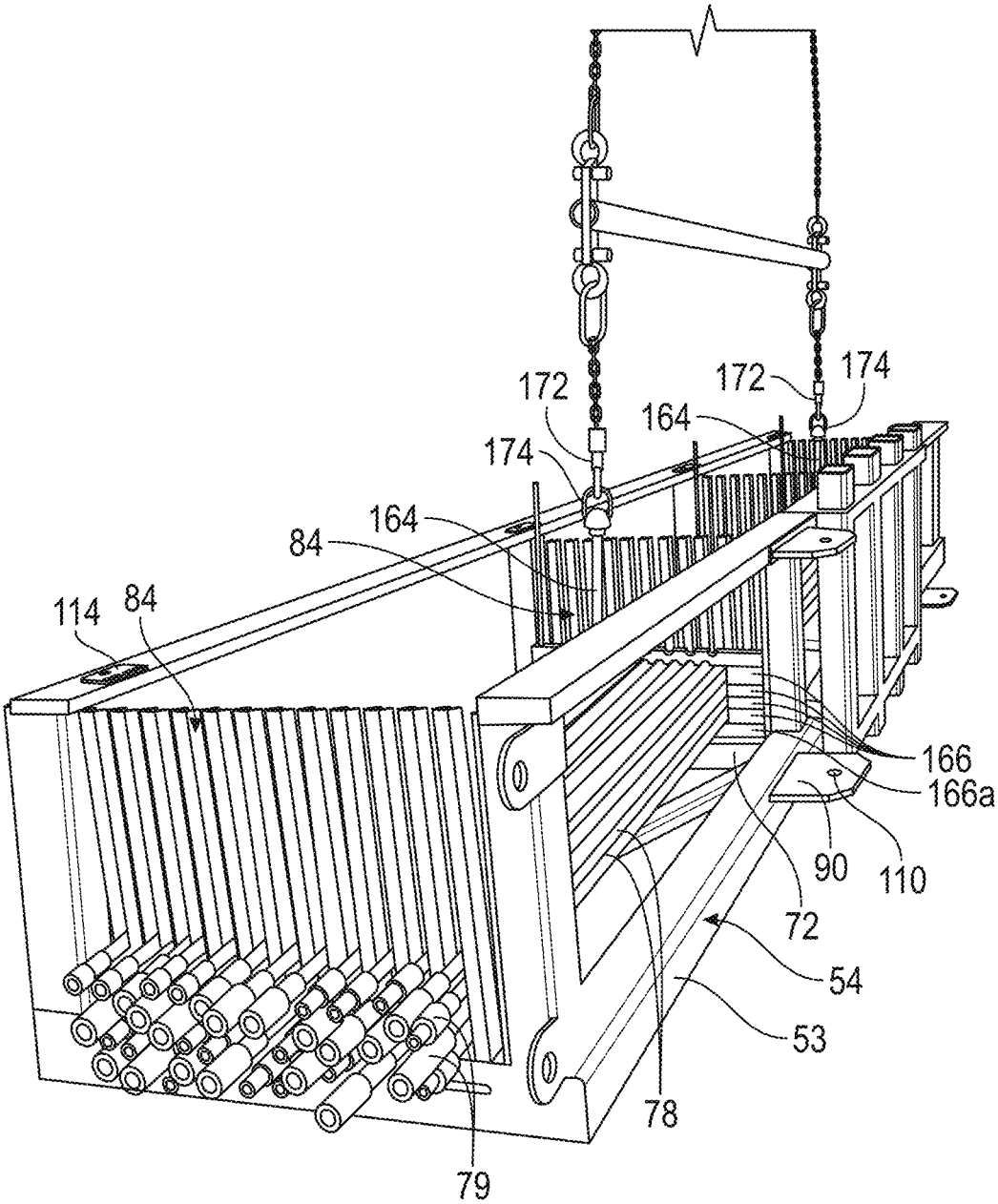
FIG. 9 is a perspective view of the assembly of rods placed into the rod crate.

FIG. 7 shows a horizontally oriented crate 54 and the rod assembly of FIG. 6 laid alongside the crate 54. As shown in FIG. 7, when the requisite number of rods 78 has been bundled with layers of cribbing bars 166, hooks 172 of an overhead crane are attached to eyelets 174 of the T-posts 164. The crane is then actuated to lift the bundle of rods by the T-posts 164 and lower it into the rod crate 54, as shown in FIG. 9, with the rods 78 positioned between guide fingers 92 and within slot pockets 94 of the aligned rod guides 84.

Figure 10A:
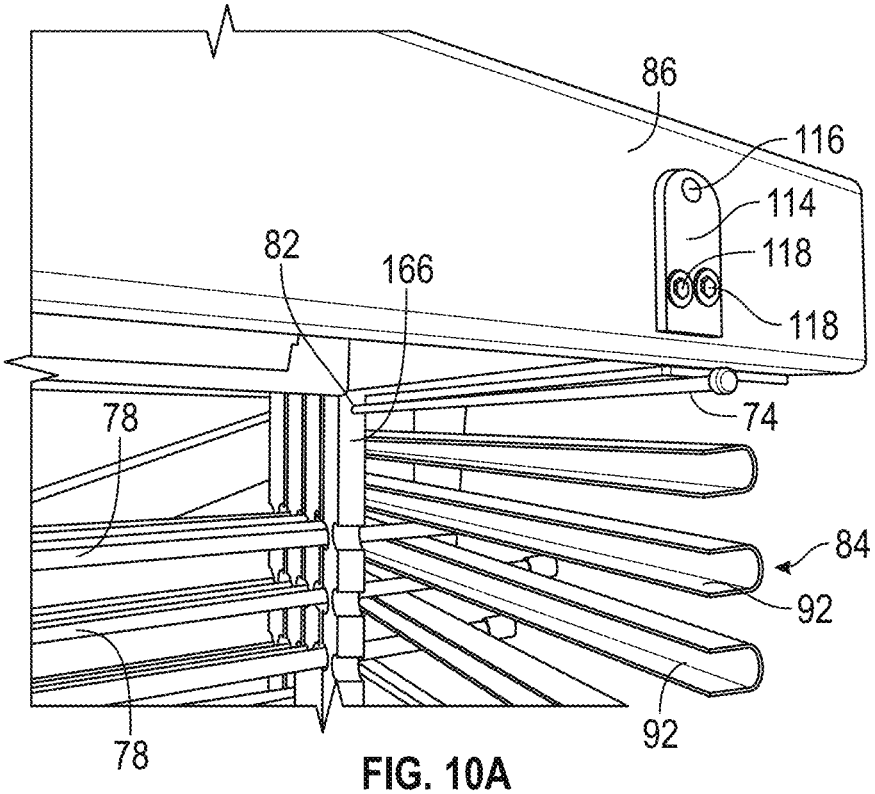
FIG. 10A is a partial top perspective view of the far end of the rod crate of FIG. 9, wherein the cribbing shaft may receive additional cribbing strips.
Figure 10B:
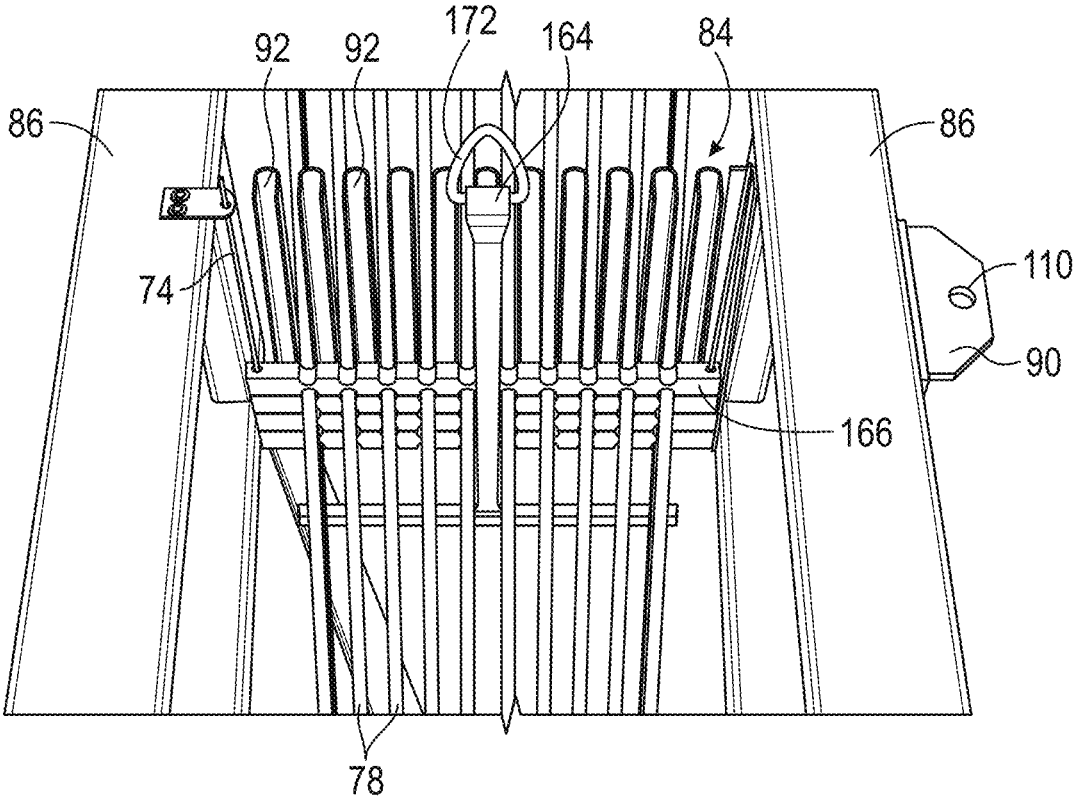
FIG. 10B is a partial top perspective view of an intermediate portion of the rod crate of FIG. 9, in the vicinity of a lifting T-post.

FIGS. 10A and 10B show partial top perspective views of portions of the crate 54 including an end rod guide 84 and an intermediate rod guide 84, respectively. As shown in FIG. 10A, the front plate 114 of cribbing assembly 66 is attached to the front face of elongated frame member 86 by fasteners through its apertures 118. As shown in FIG. 11, the front plate 114 has been unfastened from the elongated frame member 86 and refastened with a flipped orientation so that the shaft 74 can be secured in aperture 116 by fastener assembly 122 (see FIG. 4C).

The described systems and methods realize a reduction in physical labor, a reduction in potential damage to the rods, and a reduction in time associated with the conventional methods of tripping, prepping, and transporting rods. For example, the length of time used to handle each rod individually when moving the rods around a wellbore location is reduced to a few minutes versus hours. Finally, substantial cost savings to the purchaser of the rods is anticipated with the ability to prep the rods offsite and preserve their integrity in use.

Exemplary, non-limiting embodiments of a crate and a method of using a plurality of rods are described. In one embodiment, a crate 54 comprises a frame 53 and first and second rod guides 84 configured to be spaced along the frame 53. In an exemplary embodiment, the first rod guide 84 (such as at an end of crate 54) comprises a first plurality of fingers 92, and the second rod guide 84 (such as near a middle of crate 54) comprises a second plurality of fingers 92. In an exemplary embodiment, the first and second plurality of fingers 92 are configured to be aligned with each other to define a first rod receiving slot 94 between two adjacent fingers 92 of the first plurality of fingers 92, and a second rod receiving slot 94 between two adjacent fingers 92 of the second plurality of fingers 92. In an exemplary embodiment, the first and second rod receiving slots 94 are configured to accept a rod 78 from a first side of the frame 53 (see FIG. 9, for example).

In an exemplary embodiment, a cribbing bar 166, 166*a* has a plurality of saddles 124, wherein a first saddle 124 of the plurality of saddles 124 is aligned with the first and second slots 94, and wherein the first saddle 124 is configured to accept the rod 78, as shown in FIG. 9, for example. In an exemplary embodiment, a shaft 74 has opposed first and second ends, wherein the first end of the shaft 74 is attached to a first plate 72, and the shaft 74 extends substantially perpendicular from the first plate 72, as shown in FIGS. 4A and 5A, for example. In an exemplary embodiment, the cribbing bar 166, 166*a* comprises an aperture 82 through which the shaft 74 is configured to extend, as shown in FIGS. 4A-4E, for example. In an exemplary embodiment, a second plate 114 is disposed proximate the second end of the shaft 74, wherein the second plate 114 is configured for attachment to the frame 53 (as shown in FIGS. 4A, 10A and 11, for example). In an exemplary embodiment, the cribbing bar 166*a* has opposed first and second longitudinal surfaces 123; the plurality of saddles 124 are disposed on the first longitudinal surface 123, and a reinforcement bar 126 is disposed on the second longitudinal surface 123, as shown in FIGS. 4D and 4E, for example.

In an exemplary embodiment, a cribbing guide 168 is attached to the frame and configured to support an end 128 of the cribbing bar 166, 166*a*, as shown in FIGS. 4A, 5A and 11, for example. In an exemplary embodiment, a fastener 132 is attached to the cribbing guide 168 and configured to impart a compressive force on the end 128 of the cribbing bar 166, 166*a*.

In an exemplary embodiment, at least one of the first and second rod guides 84 comprises a bracket 108 configured to accept a portion of a lock bar 170, as shown in FIGS. 3A-3G, for example. In an exemplary embodiment, the bracket 108 is configured with a bore 109, and the portion of the lock bar 170 is configured as a peg 106. In an exemplary embodiment, a rod restraint strap is attached to the crate frame.

An exemplary method of using a plurality of elongated rods 78 comprises setting a plurality of T-posts 164 on a surface, as shown in FIGS. 6-8, for example. Each of the plurality of T-posts comprises 164 a spreader bar 167 and an upright post 165. An exemplary method comprises positioning the plurality of spreader bars 167 substantially parallel to each other. An exemplary method comprises setting first and second cribbing bars 166, 166*a* on the surface substantially parallel to each spreader bar 167. The first cribbing bar 166, 166*a* comprises a first plurality of saddles 124, and the second cribbing bar 166, 166*a* comprises a second plurality of saddles 124. An exemplary method comprises aligning a portion 169 of the first cribbing bar 166, 166*a* between two adjacent saddles 124 of the first plurality of saddles 124 with a first upright post 165 of the plurality of T-posts (so that the upright post 165 extends between rods 78 to be placed in the saddles 124). An exemplary method comprises disposing a first elongated rod 78 of the plurality of elongated rods 78 into one of the first plurality of saddles 124 and one of the second plurality of saddles 124 (to span across the first and second cribbing bars 166, 166*a*).

In an exemplary method, at least one of the first and second cribbing bars 166, 166*a* comprises a shaft 74 extending therethrough, and the method comprises installing a third cribbing bar 166 over the first elongated rod. In an exemplary method, installing the third cribbing bar 166 comprises passing the shaft 74 through an aperture 82 of the third cribbing bar 166. An exemplary method comprises pivoting the third cribbing bar 166 around the shaft 74.

As shown in FIGS. 7-11, an exemplary method comprises lifting the plurality of T-posts 164 and lowering the plurality of T-posts 164 into a crate 54 to position the first elongated rod 78 in the crate. An exemplary method comprises attaching an end of the shaft 74 to the crate 54 (such as with plate 72 or plate 114). An exemplary method comprises supporting an end 128 of the first cribbing bar 166, 166*a* on a cribbing guide 168 of the crate 54. An exemplary method comprises adjusting a fastener 132 of the cribbing guide 168 to exert a compressive force on the end 128 of the first cribbing bar 166, 166*a*. An exemplary method comprises adjusting a second fastener 132 to exert a compressive force on the opposite end of the first cribbing bar 166, 166*a*. An exemplary method comprises inserting the first elongated rod 78 into the first and second rod receiving slots 94 of first and second spaced rod guides 84 from a first side of the crate frame 53. In an exemplary embodiment, the first rod guide 84 comprises a bracket 108, the method comprising inserting a portion of a lock bar 170 into the bracket 108 so that the lock bar 170 spans across the first plurality of fingers 92.

Although the subject of this disclosure has been described with reference to an exemplary embodiment, workers skilled in the art will recognize that changes may be made in form and detail without departing from the scope of the disclosure. In addition, any feature disclosed with respect to one embodiment may be included in another embodiment, and vice-versa. All references mentioned in this disclosure are hereby incorporated by reference.

The invention claimed is:

1. A crate comprising:

a frame;

first and second rod guides configured to be spaced along the frame, wherein the first rod guide comprises a first plurality of fingers, and the second rod guide comprises a second plurality of fingers, wherein the first and second plurality of fingers are configured to be aligned with each other to define:

a first rod receiving slot between two adjacent fingers of the first plurality of fingers; and a second rod receiving slot between two adjacent fingers of the second plurality of fingers;

wherein the first and second rod receiving slots are configured to accept a rod from a first side of the frame;

a cribbing bar having a plurality of saddles, wherein a first saddle of the plurality of saddles is aligned with the first and second rod receiving slots, and wherein the first saddle is configured to accept the rod;

a shaft having opposed first and second ends, wherein the cribbing bar comprises an aperture through which the shaft is configured to extend; and a first plate attached to the frame, wherein a first end of a shaft is attached to the first plate.

2. The crate of claim 1, wherein the shaft extends substantially perpendicularly from the first plate.

3. The crate of claim 1 comprising a second plate disposed proximate a second end of the shaft, wherein the second plate is configured for positioning against the frame.

4. The crate of claim 1, wherein the cribbing bar:

has opposed first and second longitudinal surfaces;

the plurality of saddles are disposed on the first longitudinal surface; and a reinforcement bar is disposed on the second longitudinal surface.

5. The crate of claim 1 comprising a cribbing guide mounted on the frame and configured to support an end of the cribbing bar.

6. The crate of claim 5 comprising a mounting bracket attached to the frame, wherein the cribbing guide is selectively attachable to the mounting bracket in a plurality of positions along a length of the frame.

7. The crate of claim 1, wherein at least one of the first and second rod guides comprises a bracket configured to accept a portion of a lock bar.

8. The crate of claim 7, wherein the bracket is configured with a bore, and wherein the portion of the lock bar is configured as a peg.

9. A crate comprising:

a frame;

first and second rod guides configured to be spaced along the frame, wherein the first rod guide comprises a first plurality of fingers, and the second rod guide comprises a second plurality of fingers, wherein the first and second plurality of fingers are configured to be aligned with each other to define:

a first rod receiving slot between two adjacent fingers of the first plurality of fingers; and a second rod receiving slot between two adjacent fingers of the second plurality of fingers;

wherein the first and second rod receiving slots are configured to accept a rod from a first side of the frame;

a cribbing bar having a plurality of saddles, wherein a first saddle of the plurality of saddles is aligned with the first and second rod receiving slots, and wherein the first saddle is configured to accept the rod;

a cribbing guide mounted on the frame and configured to support an end of the cribbing bar; and a fastener attached to the cribbing guide and configured to impart a compressive force on the end of the cribbing bar.

10. The crate of claim 9 comprising a shaft having opposed first and second ends, wherein the cribbing bar comprises an aperture through which the shaft is configured to extend.

11. A method of arranging a plurality of elongated rods, the method comprising:

setting a plurality of T-posts on a surface;

wherein each of the plurality of T-posts comprises a spreader bar and an upright post; and positioning the plurality of spreader bars substantially parallel to each other;

setting first and second cribbing bars on the surface substantially parallel to each spreader bar;

wherein the first cribbing bar comprises a first plurality of saddles;

wherein the second cribbing bar comprises a second plurality of saddles;

aligning a first portion of the first cribbing bar between two adjacent saddles of the first plurality of saddles with a first upright post of the plurality of T-posts;

aligning a second portion of the second cribbing bar between two adjacent saddles of the second plurality of saddles with the first upright post; and disposing a first elongated rod of the plurality of elongated rods into one of the first plurality of saddles and one of the second plurality of saddles.

12. The method of claim 11, wherein at least one of the first and second cribbing bars comprises a shaft extending therethrough, the method comprising installing a third cribbing bar over the first elongated rod.

13. The method of claim 12, wherein installing the third cribbing bar comprises passing the shaft through an aperture of the third cribbing bar.

14. The method of claim 13 comprising:

lifting the plurality of T-posts and lowering the plurality of T-posts into a crate to position the first elongated rod in the crate; and attaching an end of the shaft to the crate.

15. The method of claim 13 comprising pivoting the third cribbing bar around the shaft.

16. The method of claim 11 comprising:

lifting the plurality of T-posts and lowering the plurality of T-posts into a crate to position the first elongated rod in the crate; and supporting an end of the first cribbing bar on a cribbing guide of the crate.

17. The method of claim 16 comprising adjusting a fastener of the cribbing guide to exert a compressive force on the end of the first cribbing bar.

18. The method of claim 11, comprising lifting the plurality of T-posts and lowering the plurality of T-posts into a crate to position the first elongated rod in the crate.

19. The method of claim 18, wherein the crate comprises:

a frame; and first and second rod guides spaced along the frame, wherein the first rod guide comprises a first plurality of fingers, and the second rod guide comprises a second plurality of fingers, wherein the first and second plurality of fingers are aligned with each other to define:

a first rod receiving slot between two adjacent fingers of the first plurality of fingers; and a second rod receiving slot between two adjacent fingers of the second plurality of fingers;

the method comprising inserting the first elongated rod into the first and second rod receiving slots from a first side of the frame.

20. The method of claim 19, wherein the first rod guide comprises a bracket, the method comprising inserting a portion of a lock bar into the bracket so that the lock bar spans across the first plurality of fingers.

* * * * *